US007861747B2

(12) United States Patent
Quigley

(10) Patent No.: US 7,861,747 B2
(45) Date of Patent: Jan. 4, 2011

(54) FORMING FABRIC HAVING EXCHANGING AND/OR BINDING WARP YARNS

(75) Inventor: Scott Quigley, Bossler City, LA (US)

(73) Assignee: Voith Patent GmbH, Heidenheim (DE)

( * ) Notice: Subject to any disclaimer, the term of this patent is extended or adjusted under 35 U.S.C. 154(b) by 366 days.

(21) Appl. No.: 12/071,206

(22) Filed: Feb. 19, 2008

(65) Prior Publication Data

US 2009/0205740 A1 Aug. 20, 2009

(51) Int. Cl.
*D03D 3/04* (2006.01)
*D03D 25/00* (2006.01)

(52) U.S. Cl. ..... 139/383 A; 139/383 R; 139/383 AA; 162/358.2

(58) Field of Classification Search ..... 139/383 R, 139/383 A, 383 AA, 408, 411, 412, 413, 139/414; 162/348, 358.1, 358.2, 900, 902, 162/903, 904
See application file for complete search history.

(56) References Cited

U.S. PATENT DOCUMENTS

| | | | |
|---|---|---|---|
| 3,867,766 | A | 2/1975 | Wagner |
| 4,224,372 | A | 9/1980 | Romanski |
| 4,239,065 | A | 12/1980 | Trokhan |
| 4,314,589 | A | 2/1982 | Buchanan et al. |
| 4,423,755 | A | 1/1984 | Thompson |
| 4,501,303 | A | 2/1985 | Osterberg |
| 4,564,052 | A | 1/1986 | Borel |
| 4,832,090 | A | 5/1989 | Krenkel et al. |
| 5,101,866 | A | 4/1992 | Quigley |
| 5,151,316 | A | 9/1992 | Durkin et al. |
| 5,152,326 | A | 10/1992 | Vohringer |
| 5,324,248 | A | 6/1994 | Quigley |
| 5,343,896 | A | 9/1994 | Schroder et al. |
| 5,429,686 | A | 7/1995 | Chiu et al. |
| 5,437,315 | A | 8/1995 | Ward |
| 5,456,293 | A | 10/1995 | Ostermayer et al. |
| 5,520,225 | A | 5/1996 | Quigley et al. |
| 5,542,455 | A | 8/1996 | Ostermayer et al. |
| 5,555,917 | A | 9/1996 | Quigley |
| 5,694,980 | A | 12/1997 | Quigley |
| 5,713,397 | A | 2/1998 | Quigley |
| 5,731,059 | A | 3/1998 | Smith et al. |
| 5,817,213 | A | 10/1998 | Ostermayer et al. |
| 5,826,627 | A | 10/1998 | Seabrook et al. |
| 5,840,411 | A | 11/1998 | Stelljes et al. |
| 5,853,547 | A | 12/1998 | Ahrens et al. |
| 5,945,357 | A | 8/1999 | Quigley |
| 5,967,195 | A | 10/1999 | Ward |

(Continued)

FOREIGN PATENT DOCUMENTS

| | | |
|---|---|---|
| EP | 0 794 283 | 9/1995 |

(Continued)

OTHER PUBLICATIONS

U.S. Appl. No. 12/071,207, filed Feb. 19, 2008.

*Primary Examiner*—Bobby H Muromoto, Jr.
(74) *Attorney, Agent, or Firm*—Greenblum & Bernstein, P.L.C.

(57) ABSTRACT

Forming fabric that includes a top layer having top weft yarns and a bottom layer having bottom weft yarns. At least one pair of binding warp yarns and at least two adjacent pairs of top and bottom warp yarns are utilized.

42 Claims, 12 Drawing Sheets

U.S. PATENT DOCUMENTS

| | | | | |
|---|---|---|---|---|
| 5,988,229 | A | 11/1999 | Quigley | |
| 6,148,869 | A | 11/2000 | Quigley | |
| 6,202,705 | B1 | 3/2001 | Johnson et al. | |
| 6,227,256 | B1 | 5/2001 | Quigley | |
| 6,237,644 | B1 | 5/2001 | Hay et al. | |
| 6,349,749 | B1 | 2/2002 | Quigley | |
| 6,530,398 | B1 | 3/2003 | Westerkamp | |
| 6,546,964 | B1 | 4/2003 | Westerkamp | |
| 6,581,645 | B1 | 6/2003 | Johnson et al. | |
| 6,592,714 | B2 | 7/2003 | Lamb | |
| 6,649,026 | B2 | 11/2003 | Lamb | |
| 6,834,684 | B2 | 12/2004 | Martin et al. | |
| 6,860,299 | B2 | 3/2005 | Kuji | |
| 6,926,043 | B2 | 8/2005 | Quigley et al. | |
| 6,953,065 | B2 | 10/2005 | Martin et al. | |
| 6,959,737 | B2 | 11/2005 | Ward | |
| 6,978,809 | B2 | 12/2005 | Quigley | |
| 7,007,722 | B2 | 3/2006 | Quigley et al. | |
| 7,048,012 | B2 | 5/2006 | Martin et al. | |
| 7,059,357 | B2 | 6/2006 | Ward | |
| 7,059,359 | B2 | 6/2006 | Quigley et al. | |
| 2002/0056536 | A1 | 5/2002 | Lamb | |
| 2004/0020621 | A1 | 2/2004 | Heger et al. | |
| 2004/0079434 | A1 | 4/2004 | Martin et al. | |
| 2004/0182465 | A1 | 9/2004 | Word | |
| 2004/0231745 | A1* | 11/2004 | Quigley et al. | 139/383 A |
| 2004/0238062 | A1 | 12/2004 | Quigley et al. | |
| 2005/0051230 | A1* | 3/2005 | Martin et al. | 139/383 R |
| 2005/0067040 | A1* | 3/2005 | Quigley | 139/383 A |
| 2005/0103397 | A1* | 5/2005 | Quigley et al. | 139/383 A |
| 2005/0139281 | A1* | 6/2005 | Martin et al. | 139/383 A |
| 2005/0167066 | A1 | 8/2005 | Herman et al. | |
| 2006/0009582 | A1 | 1/2006 | Zhang et al. | |
| 2006/0016505 | A1 | 1/2006 | Westerkamp | |
| 2006/0016509 | A1 | 1/2006 | Westerkamp et al. | |
| 2006/0048840 | A1* | 3/2006 | Quigley | 139/408 |
| 2006/0060321 | A1 | 3/2006 | Quigley et al. | |
| 2006/0063451 | A1 | 3/2006 | Serr et al. | |
| 2006/0085999 | A1 | 4/2006 | Scherb et al. | |
| 2006/0219312 | A1* | 10/2006 | Hay et al. | 139/383 A |
| 2006/0243338 | A1* | 11/2006 | Hawes et al. | 139/383 A |
| 2006/0278294 | A1* | 12/2006 | Quigley | 139/383 A |
| 2007/0006934 | A1* | 1/2007 | Quigley et al. | 139/383 R |
| 2007/0006935 | A1* | 1/2007 | Quigley et al. | 139/383 R |
| 2007/0028996 | A1* | 2/2007 | Quigley | 139/383 R |
| 2007/0068590 | A1* | 3/2007 | Quigley et al. | 139/383 A |
| 2007/0215304 | A1 | 9/2007 | Fernandes et al. | |
| 2007/0240842 | A1 | 10/2007 | Scherb et al. | |
| 2007/0251659 | A1 | 11/2007 | Fernandes et al. | |
| 2007/0251660 | A1 | 11/2007 | Walkenhaus et al. | |
| 2007/0272385 | A1 | 11/2007 | Quigley et al. | |
| 2008/0105323 | A1* | 5/2008 | Hay et al. | 139/383 A |
| 2008/0149213 | A1* | 6/2008 | Quigley | 139/408 |
| 2008/0149214 | A1* | 6/2008 | Quigley | 139/410 |
| 2008/0196784 | A1* | 8/2008 | Quigley | 139/383 A |

FOREIGN PATENT DOCUMENTS

| | | |
|---|---|---|
| EP | 1 000 197 | 6/2002 |
| WO | 02/00996 | 1/2002 |
| WO | 2005/035867 | 4/2005 |
| WO | 2005/075732 | 8/2005 |
| WO | 2005/075737 | 8/2005 |
| WO | 2006/113818 | 10/2006 |

* cited by examiner

Fig. 1

| | | | | | | | | | | | | | |
|---|---|---|---|---|---|---|---|---|---|---|---|---|---|
| | X | C | X | | B | | X | C | X | | A | 18 | |
| X | | B | | X | Y | X | | A | | X | Z | 16 | 17 |
| | X | C | X | | B | | X | C | X | | A | 15 | |
| X | | D | | X | C | X | | E | | X | C | 13 | 14 |
| | X | C | X | | A | | X | C | X | | B | 12 | |
| X | | B | | X | C | X | | A | | X | C | 10 | 11 |
| | X | C | X | | A | | X | C | X | | B | 9 | |
| X | | A | | X | Z | X | | Z | | X | Y | 7 | 8 |
| | X | C | X | | A | | X | C | X | | B | 6 | |
| X | | E | | X | C | X | | D | | X | C | 4 | 5 |
| | X | C | X | | B | | X | C | X | | A | 3 | |
| X | | A | | X | C | X | | B | | X | C | 1 | 2 |
| 1 | 3 | 5 | 7 | 9 | 11 | 13 | 15 | 17 | 19 | 21 | 23 | | |
| 2 | 4 | 6 | 8 | 10 | 12 | 14 | 16 | 18 | 20 | 22 | 24 | | |

Fig. 3

| | | | | | | | | | | | | | |
|---|---|---|---|---|---|---|---|---|---|---|---|---|---|
| C | B | | X | C | B | | X | C | A | | X | 36 | |
| B | C | X | | E | Y | X | | A | C | X | | 34 | 35 |
| C | A | | X | C | B | | X | C | A | | X | 33 | |
| B | C | X | | A | C | X | | E | Z | X | | 31 | 32 |
| C | A | | X | C | B | | X | C | A | | X | 30 | |
| D | Z | X | | B | C | X | | A | C | X | | 28 | 29 |
| C | A | | X | C | B | | X | C | B | | X | 27 | |
| B | C | X | | D | Y | X | | A | C | X | | 25 | 26 |
| C | A | | X | C | B | | X | C | B | | X | 24 | |
| A | C | X | | B | C | X | | E | Y | X | | 22 | 23 |
| C | A | | X | C | A | | X | C | B | | X | 21 | |
| E | Z | X | | B | C | X | | A | C | X | | 19 | 20 |
| C | A | | X | C | A | | X | C | B | | X | 18 | |
| A | C | X | | D | Z | X | | B | C | X | | 16 | 17 |
| C | B | | X | C | A | | X | C | B | | X | 15 | |
| A | C | X | | B | C | X | | D | Y | X | | 13 | 14 |
| C | B | | X | C | A | | X | C | B | | X | 12 | |
| E | Y | X | | A | C | X | | B | C | X | | 10 | 11 |
| C | B | | X | C | A | | X | C | A | | X | 9 | |
| A | C | X | | E | Z | X | | B | C | X | | 7 | 8 |
| C | B | | X | C | A | | X | C | A | | X | 6 | |
| B | C | X | | A | C | X | | D | Z | X | | 4 | 5 |
| C | B | | X | C | B | | X | C | A | | X | 3 | |
| D | Y | X | | A | C | X | | B | C | X | | 1 | 2 |
| 1 | 3 | 5 | 7 | 9 | 11 | 13 | 15 | 17 | 19 | 21 | 23 | | |
| 2 | 4 | 6 | 8 | 10 | 12 | 14 | 16 | 18 | 20 | 22 | 24 | | |

Fig. 5

| | | | | | | | | | | | | | |
|---|---|---|---|---|---|---|---|---|---|---|---|---|---|
| X | | B | | X | C | X | | A | | X | C | 36 | |
| | X | C | X | | E | | X | C | X | | D | 34 | 35 |
| X | | B | | X | C | X | | B | | X | C | 33 | |
| | X | Y | X | | A | | X | Y | X | | B | 31 | 32 |
| X | | B | | X | C | X | | B | | X | C | 30 | |
| | X | C | X | | E | | X | C | X | | D | 28 | 29 |
| X | | A | | X | C | X | | B | | X | C | 27 | |
| | X | Z | X | | A | | X | Y | X | | B | 25 | 26 |
| X | | A | | X | C | X | | B | | X | C | 24 | |
| | X | C | X | | E | | X | C | X | | E | 22 | 23 |
| X | | A | | X | C | X | | B | | X | C | 21 | |
| | X | Z | X | | B | | X | Y | X | | A | 19 | 20 |
| X | | A | | X | C | X | | B | | X | C | 18 | |
| | X | C | X | | D | | X | C | X | | E | 16 | 17 |
| X | | A | | X | C | X | | A | | X | C | 15 | |
| | X | Z | X | | B | | X | Z | X | | A | 13 | 14 |
| X | | A | | X | C | X | | A | | X | C | 12 | |
| | X | C | X | | D | | X | C | X | | E | 10 | 11 |
| X | | B | | X | C | X | | A | | X | C | 9 | |
| | X | Y | X | | B | | X | Z | X | | A | 7 | 8 |
| X | | B | | X | C | X | | A | | X | C | 6 | |
| | X | C | X | | D | | X | C | X | | D | 4 | 5 |
| X | | B | | X | C | X | | A | | X | C | 3 | |
| | X | Y | X | | A | | X | Z | X | | B | 1 | 2 |
| 1 | 3 | 5 | 7 | 9 | 11 | 13 | 15 | 17 | 19 | 21 | 23 | | |
| 2 | 4 | 6 | 8 | 10 | 12 | 14 | 16 | 18 | 20 | 22 | 24 | | |

FORMING FABRIC HAVING EXCHANGING AND/OR BINDING WARP YARNS

BACKGROUND OF THE INVENTION

1. Field of the Invention

The present invention relates generally to papermaking, and relates more specifically to multilayer fabrics employed in papermaking. The invention also relates to the binding of multilayered forming fabric with warp yarns. The present invention also relates to multilayer papermaker's fabrics that utilizes warp yarns to bind top and bottom layers such without disrupting the top fabric surface. The invention also provides for a fabric which utilizes at least one pair of non-exchanging warp yarns between pairs of exchanging warp yarns, i.e., a pair of exchanging warp yarns has two pairs of non-exchanging warp yarns on each side thereof. The invention also provides for a fabric which utilizes at least two pairs of non-exchanging warp yarns between two pairs of exchanging warp yarns, i.e., two adjacent pairs of exchanging warp yarns have two pairs of non-exchanging warp yarns on each side thereof.

2. Discussion of Background Information

In the conventional fourdrinier papermaking process, a water slurry, or suspension, of cellulosic fibers (known as the paper "stock") is fed onto the top of the upper run of an endless belt of woven wire and/or synthetic material that travels between two or more rolls. The belt, often referred to as a "forming fabric," provides a papermaking surface on the upper surface of its upper run which operates as a filter to separate the cellulosic fibers of the paper stock from the aqueous medium, thereby forming a wet paper web. The aqueous medium drains through mesh openings of the forming fabric, known as drainage holes, by gravity or vacuum located on the lower surface of the upper run (i.e., the "machine side") of the fabric.

After leaving the forming section, the paper web is transferred to a press section of the paper machine, where it is passed through the nips of one or more pairs of pressure rollers covered with another fabric, typically referred to as a "press felt." Pressure from the rollers removes additional moisture from the web; the moisture removal is often enhanced by the presence of a "batt" layer of the press felt. The paper is then transferred to a dryer section for further moisture removal. After drying, the paper is ready for secondary processing and packaging.

Typically, papermaker's fabrics are manufactured as endless belts by one of two basic weaving techniques. In the first of these techniques, fabrics are flat woven by a flat weaving process, with their ends being joined to form an endless belt by any one of a number of well-known joining methods, such as dismantling and reweaving the ends together (commonly known as splicing), or sewing on a pin-seamable flap or a special foldback on each end, then reweaving these into pin-seamable loops. A number of auto-joining machines are available, which for certain fabrics may be used to automate at least part of the joining process. In a flat woven papermaker's fabric, the warp yarns extend in the machine direction and the filling yarns or weft yarns extend in the cross machine direction.

In the second basic weaving technique, fabrics are woven directly in the form of a continuous belt with an endless weaving process. In the endless weaving process, the warp yarns extend in the cross machine direction and the filling yarns or weft yarns extend in the machine direction. Both weaving methods described hereinabove are well known in the art, and the term "endless belt" as used herein refers to belts made by either method.

Effective sheet and fiber support are important considerations in papermaking, especially for the forming section of the papermaking machine, where the wet web is initially formed. Additionally, the forming fabrics should exhibit good stability when they are run at high speeds on the papermaking machines, and preferably are highly permeable to reduce the amount of water retained in the web when it is transferred to the press section of the paper machine. In both tissue and fine paper applications (i.e., paper for use in quality printing, carbonizing, cigarettes, electrical condensers, and like) the papermaking surface comprises a very finely woven or fine wire mesh structure.

Prior art fabrics are not known to utilize at least one pair of non-exchanging warp yarns between pairs of exchanging warp yarns, i.e., a pair of exchanging warp yarns has two pairs of non-exchanging warp yarns on each side thereof and/or at least two pairs of non-exchanging warp yarns between two pairs of exchanging warp yarns, i.e., two adjacent pairs of exchanging warp yarns have two pairs of non-exchanging warp yarns on each side thereof.

U.S. Pat. No. 6,860,299 to KUJI, the disclosure of which is hereby expressly incorporated by reference in its entirety, discloses a fabric which utilizes alternating pairs of non-exchanging warp yarns and alternating pairs of exchanging warp yarns, i.e., one pair of exchanging warp yarns between two pairs of non-exchanging warp yarns.

U.S. Pat. No. 4,501,303 to OSTERBERG, the disclosure of which is hereby expressly incorporated by reference in its entirety, discloses a fabric which utilizes yarns of different thicknesses in the top and bottom layers and binder yarns to connect the top and bottom layers.

U.S. Pat. No. 5,152,326 to VOHRINGER, the disclosure of which is hereby expressly incorporated by reference in its entirety, discloses a warp bound fabric which utilizes interchanging warp pairs wherein each binder weaves a full repeat pattern of the weave design on the wearside.

EP 1 000 197 to WARD, the disclosure of which is hereby expressly incorporated by reference in its entirety, discloses a weft bound fabric which utilizes binders that bind in the middle of a four float, 5 shed design. The binder segments of both binders are of different lengths.

EP 0 794 283 to SEABROOK, the disclosure of which is hereby expressly incorporated by reference in its entirety, discloses a fabric wherein each weft yarn only binds over one wearside warp. Each binder yarn binds with every S/4 (S=number of shafts) warp yarn. The ratio of the warps 1 one to one, top to bottom.

SUMMARY OF THE INVENTION

The fabric of the present invention may be made using the prior art methods described above. The invention also provides for a multilayer fabric employed in papermaking. The invention further also provides for the binding of multilayered forming fabric using warp yarns such as top and bottom warp yarns. The present invention also relates to multilayer papermaker's fabrics that utilizes warp yarns to bind top and bottom layers such without disrupting the top fabric surface.

The present invention also provides for a warp-bound, warp exchange forming fabric whereby at least one warp-binder pair if separated from the next warp binder pair by at least two adjacent pairs of non-exchanging warp yarns. This can provide the fabric with a smoother paper-side surface (because it has less interchange points) and a greater permeability range than is possible with prior art forming fabrics.

By way of non-limiting example, the present invention provides for a forming fabric having top warp yarns of about 0.18 mm diameter, bottom warp yarns of about 0.27 mm diameter, top weft yarns of about 0.18 mm diameter, and bottom weft yarns of about 0.45 mm diameter. The top or paper side of the fabric can utilize a finished mesh of about 66. The bottom or machine side of the fabric can utilize a finished mesh of about 66. The top or paper side of the fabric can utilize a finished count of about 58. The bottom or machine side of the fabric can utilize a finished count of about 29. The fabric can have an air permeability of about 430 CFM.

The invention also provides for a fabric which utilizes at least one pair of non-exchanging warp yarns between pairs of exchanging warp yarns, i.e., a pair of exchanging warp yarns has two pairs of non-exchanging warp yarns on each side thereof. The invention also provides for a fabric which utilizes at least two pairs of non-exchanging warp yarns between two pairs of exchanging warp yarns, i.e., two adjacent pairs of exchanging warp yarns have two pairs of non-exchanging warp yarns on each side thereof.

The present invention also relates to a forming fabric comprising a forming fabric comprising a top layer comprising top weft yarns, a bottom layer comprising bottom weft yarns, at least two pairs of adjacent binding warp yarns, and at least two pairs of adjacent top and bottom warp yarns.

One pair of the at least two pairs of binding warp yarns may be arranged adjacent one of the at least two adjacent top and bottom warp yarns. At least one of the at least two pairs of binding warp yarns may comprise vertically stacked binding warp yarns weaving with a plain weave in the top layer and binding with non-adjacent bottom weft yarns. Each of the at least two pairs of binding warp yarns may comprise vertically stacked binding warp yarns weaving with a plain weave in the top layer and binding with non-adjacent bottom weft yarns. At least one of the at least two pairs of binding warp yarns may comprise vertically stacked binding warp yarns weaving with a plain weave in the top layer and binding with two non-adjacent bottom weft yarns. Each of the at least two pairs of binding warp yarns may comprise vertically stacked binding warp yarns weaving with a plain weave in the top layer and binding with two non-adjacent bottom weft yarns.

The at least two pairs of binding warp yarns may comprise a first pair of vertically stacked binding warp yarns weaving with a plain weave in the top layer and binding with two non-adjacent bottom weft yarns and a second pair of vertically stacked binding warp yarns weaving with a plain weave in the top layer and binding with two different non-adjacent bottom weft yarns. At least one of the at least two pairs of binding warp yarns may comprise a first binding warp yarn binding with bottom weft yarns per pattern repeat and being arranged adjacent one of the at least two adjacent top warp yarns and a second binding warp yarn weaving with top weft yarns and being arranged adjacent one of the at least two adjacent bottom warp yarns. At least one of the at least two pairs of binding warp yarns may comprise a first binding warp yarn weaving with a plain weave in the top layer, binding with at least two bottom weft yarns per pattern repeat, and being arranged adjacent one of the at least two adjacent top warp yarns and a second binding warp yarn weaving with a plain weave in the top layer, binding with at least two top weft yarns per pattern repeat, and being arranged adjacent one of the at least two adjacent bottom warp yarns.

The top warp yarns may weave only in the top layer form a plain weave with the top weft yarns. The bottom warp yarns may weave only in the bottom layer bind with non-adjacent bottom weft yarns per pattern repeat. The bottom warp yarns may weave only in the bottom layer bind with two non-adjacent bottom weft yarns per pattern repeat. The at least two pairs of binding warp yarns may comprise two adjacent first binding warp yarns passing over more top weft yarns than bottom weft yarns and two adjacent second binding warp yarns passing over more top weft yarns than bottom weft yarns. At least one of the at least two pairs of binding warp yarns may comprise a first binding warp yarn weaving with a plain weave with a first set of top weft yarns and a second binding warp yarn weaving with a plain weave with a second set of top weft yarns. At least one of the at least two pairs of binding warp yarns may comprise a first binding warp yarn weaving with a plain weave with a first set of top weft yarns and a second binding warp yarn weaving with a plain weave with a different second set of top weft yarns.

The at least two pairs of binding warp yarns may comprise two adjacent first binding warp yarns weaving with a plain weave with a first set of top weft yarns and two adjacent second binding warp yarns weaving with a plain weave with a second set of top weft yarns. The at least two pairs of binding warp yarns may comprise two adjacent first binding warp yarns weaving with a plain weave with a first set of top weft yarns and two adjacent second binding warp yarns weaving with a plain weave with a different second set of top weft yarns.

At least one of the top layer may have a different weave pattern than the bottom layer and the top layer utilizes a plain weave and the bottom layer does not utilize a plain weave. The top layer may have a papermaking surface and the bottom has a machine side surface. Each of the top warp yarns may weave only in the top layer is vertically stacked with respect to each of the bottom warp yarns weaving only in the bottom layer. The at least two pairs of binding warp yarns may be vertically stacked. At least one of the top warp yarns per pattern repeat may differ from the bottom warp yarns in at least one of the following characteristics size, modulus, and material. At least one of the top weft yarns per pattern repeat may differ from the bottom weft yarns in at least one of the following characteristics size, modulus, and material. At least one of the top warp yarns may be smaller in size than at least one of the bottom warp yarns. Each of the at least two adjacent pairs of binding warp yarns may bind with only two bottom weft yarns per pattern repeat Each of the at least two adjacent pairs of binding warp yarns may weave in the top layer with a plain weave and bind with only two bottom weft yarns per pattern repeat Each of the at least two adjacent pairs of binding warp yarns may comprise intrinsic binding warp yarns.

The at least two adjacent pairs of binding warp yarns may comprise two adjacent first binding warp yarns each binding with two bottom weft yarns per pattern repeat and weaving with plural top weft yarns and two adjacent second binding warp yarns each binding with two bottom weft yarns per pattern repeat and weaving with plural two top weft yarns. The at least two adjacent pairs of binding warp yarns may comprise two adjacent first binding warp yarns each binding with two bottom weft yarns per pattern repeat and weaving with plural top weft yarns in a plain weave and two adjacent second binding warp yarns each binding with two bottom weft yarns per pattern repeat and weaving with plural two top weft yarns in a plain weave. The at least two adjacent pairs of binding warp yarns may comprise two adjacent first binding warp yarns each binding with two different bottom weft yarns per pattern repeat and weaving with plural top weft yarns in a plain weave and two adjacent second binding warp yarns each binding with two different bottom weft yarns per pattern repeat and weaving with plural two top weft yarns in a plain weave. The at least two adjacent pairs of binding warp yarns may comprise two adjacent first binding warp yarns each binding with two non-adjacent bottom weft yarns per pattern repeat and weaving with plural top weft yarns in a plain weave and two adjacent second binding warp yarns each binding with two non-adjacent bottom weft yarns per pattern repeat and weaving with plural two top weft yarns in a plain weave. The at least two adjacent pairs of binding warp yarns may comprise two adjacent first binding warp yarns each binding with two different non-adjacent bottom weft yarns per pattern repeat and weaving with plural top weft yarns in a plain weave and two adjacent second binding warp yarns each binding with two different non-adjacent bottom weft yarns per pattern repeat and weaving with plural two top weft yarns in a plain weave. The at least two adjacent pairs of binding warp yarns comprises two adjacent first binding warp yarns each binding with two bottom weft yarns per pattern repeat and weaving with eleven top weft yarns and two adjacent second binding warp yarns each binding with two bottom weft yarns per pattern repeat and weaving with eleven top weft yarns.

The invention also provides for a forming fabric comprising a top layer comprising top weft yarns, a bottom layer comprising bottom weft yarns, and in a pattern repeat, at least the following warp yarns: a first pair of top and bottom warp yarns; a second pair of top and bottom warp yarns arranged adjacent the first pair; a pair of binding warp yarns arranged adjacent the second pair; a third pair of top and bottom warp yarns arranged adjacent the pair of binding warp yarns; and a fourth pair of top and bottom warp yarns arranged adjacent the third pair.

At least one of the bottom warp yarns weave with non-adjacent bottom weft yarns, the bottom warp yarns weave with two non-adjacent bottom weft yarns, the bottom warp yarns weave with four non-adjacent bottom weft yarns, and the bottom warp yarns weave with different non-adjacent bottom weft yarns.

At least one of each binding warp yarn weaves in the top layer with a plain weave and binds with non-adjacent bottom weft yarns, each binding warp yarn weaves in the top layer with a plain weave and binds with two non-adjacent bottom weft yarns, and each binding warp yarn weaves in the top layer with a plain weave and binds with four non-adjacent bottom weft yarns.

The invention also provides for a forming fabric comprising a top layer comprising top weft yarns, a bottom layer comprising bottom weft yarns, and in a pattern repeat, at least the following warp yarns: a first pair of top and bottom warp yarns; a second pair of top and bottom warp yarns arranged adjacent the first pair; a third pair of top and bottom warp yarns; a fourth pair of top and bottom warp yarns arranged adjacent the third pair; and two pairs of adjacent binding warp yarns arranged between the second and third pairs.

Each of the top warp yarns may weave with a plain weave in the top layer and each of the bottom warp yarns may weave in the bottom layer with a non-plain weave and each of the binding warp yarns may weave with a plain weave in the top layer and bind to non-adjacent bottom weft yarns.

The invention also provides for a method of making the fabric of any of the types described above, wherein the method comprises binding together the top and bottom layers.

The invention also provides for a method of making the fabric of any of the types described above, wherein the method comprises weaving together the top and bottom layers with the at least two pairs of adjacent binding warp yarns.

Additional aspects of the present invention include methods of manufacturing warp-stitched triple layer fabrics and methods of using the triple layer papermaker's fabric described herein for making paper.

BRIEF DESCRIPTION OF THE FIGURES

The present invention is further described in the detailed description which follows, in reference to the noted plurality of drawings by way of non-limiting examples of exemplary embodiments of the present invention, in which like reference numerals represent similar parts throughout the several views of the drawings, and wherein:

FIG. 1 shows a weave pattern repeat of a first embodiment of the present invention;

FIG. 3 shows a weave pattern repeat of a second embodiment of the present invention;

FIG. 5 shows a weave pattern repeat of a third embodiment of the present invention;

DETAILED DESCRIPTION OF THE INVENTION

Figure 2A:
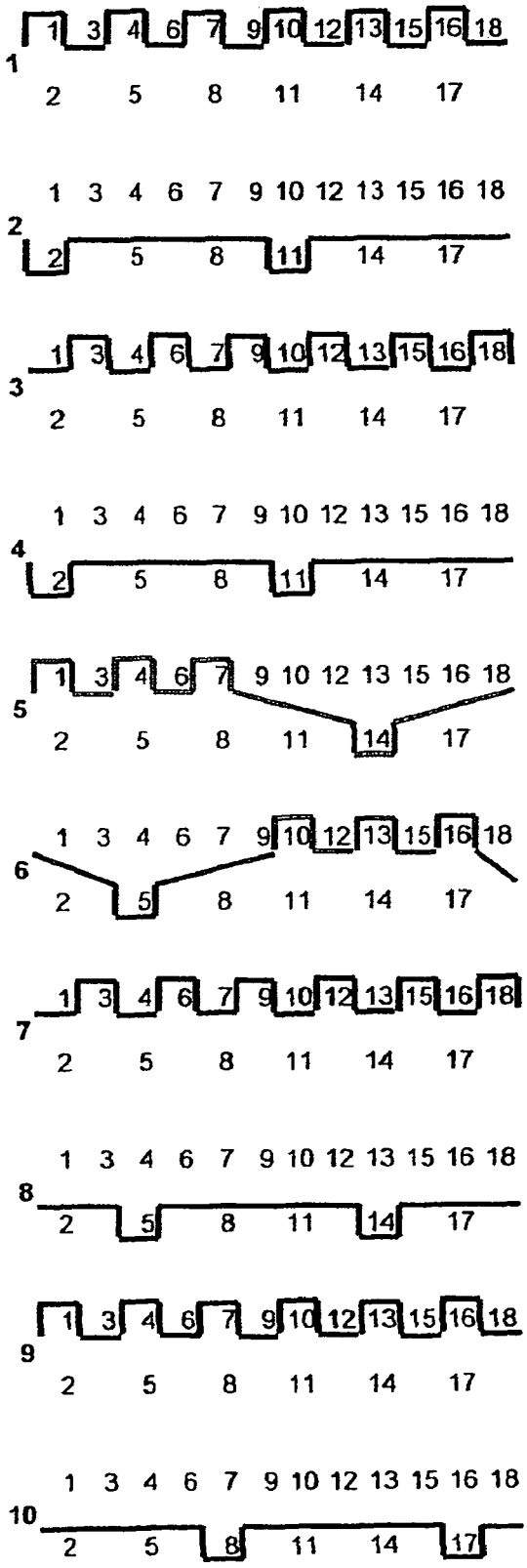
FIG. 2*a* shows a cross-section view of the repeat shown in FIG. 1 and illustrates top warp yarns 1, 3, 7 and 9 (listed on the left-hand side) with warp yarn 5 being a binding warp yarn and bottom warp yarns 2, 4, 8 and 10 (listed on the left-hand side) with warp yarn 6 being a binding warp yarn. The top and bottom weft yarns 1-18 are listed horizontally right to left.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

In FIGS. 1, 3 and 5, a blank cell is shown in locations where a non-exchanging or top warp yarn passes under a top weft yarn while a bottom warp yarn passes under a bottom weft yarn. Symbol X in an un-shaded cell is shown in locations where a non-exchanging or top warp yarn passes over a top weft yarn while a non-exchanging bottom warp yarn passes under a bottom weft yarn. A shaded cell is shown in locations where a non-exchanging or top warp yarn passes under a top weft yarn while a non-exchanging bottom warp yarn passes over a bottom weft yarn. Symbol X in a shaded cell is shown in locations where a non-exchanging or top warp yarn passes over a top weft yarn while a non-exchanging bottom warp yarn passes over a bottom weft yarn. Symbol Y is shown in locations where an exchanging or binding warp yarn passes over a bottom weft yarn while an exchanging or binding warp yarn passes under a top weft yarn. Symbol Z is shown in locations where an exchanging or binding warp yarn passes under a top weft yarn while an exchanging or binding warp yarn passes over a bottom weft yarn. Symbol A is shown in locations where an exchanging or binding warp yarn passes over a top weft yarn while an exchanging or binding warp yarn passes under a bottom weft yarn. Symbol B is shown in locations where an exchanging or binding warp yarn passes under a top weft yarn while an exchanging or binding warp yarn passes over a top weft yarn. Symbol C is shown in locations where an exchanging or binding warp yarn passes under a top weft yarn while an exchanging or binding warp yarn passes under a top weft yarn. Symbol D is shown in locations where an exchanging or binding warp yarn passes over a bottom weft yarn while an exchanging or binding warp yarn passes over a top weft yarn. Symbol E is shown in locations where an exchanging or binding warp yarn passes over a top weft yarn while an exchanging or binding warp yarn passes over a bottom weft yarn. As used herein, the term "over" in reference to a weave pattern of a warp yarn in the top layer means that the yarn passes vertically above a paper-side surface of the fabric and then over a top weft yarn. The term "over" in reference to a weave pattern of a warp yarn in the bottom layer means that the yarn passes vertically below a machine-side surface and then over a top weft yarn as opposed to passing between the top and bottom weft yarns.

FIG. 1 shows a first non-limiting embodiment of the invention and depicts a top pattern view of the top fabric layer of the multilayer fabric (i.e., a view of the papermaking surface). The numbers 1-24 shown on the bottom of the pattern identify the upper and lower (as well as binding) warp yarns while the right side numbers 1-18 show the upper or top and lower or bottom weft yarns. The upper or top warp (including binding warp) yarns shown on the bottom of the pattern are 1, 3, 5, 7, 9, 11, 13, 15, 17, 19, 21 and 23. The lower or bottom warp (including binding warp) yarns shown on the bottom of the pattern are 2, 4, 6, 8, 10, 12, 14, 16, 18, 20, 22 and 24. The upper or top weft yarns shown on the right side of the pattern are 1, 2, 4, 6, 7, 9, 10, 12, 13, 15, 16 and 18. The lower or bottom weft yarns shown on the right side of the pattern are 2, 5, 8, 11, 14 and 17.

Figure 2B:
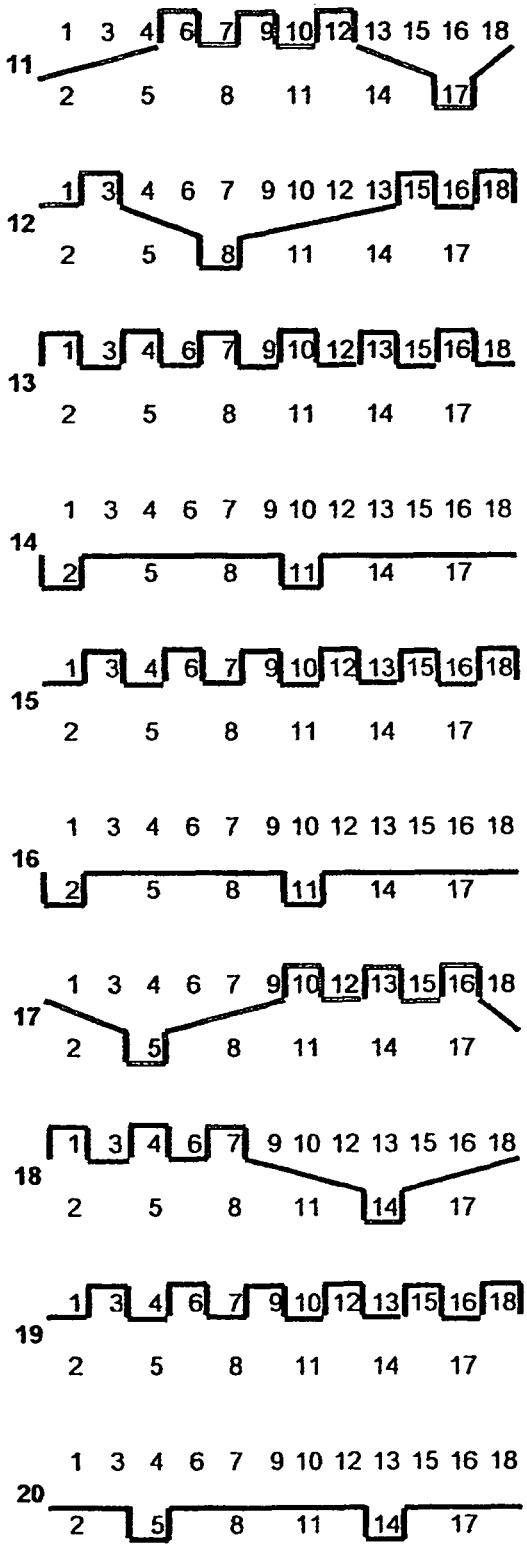
FIG. 2*b* shows a cross-section view of the repeat shown in FIG. 1 and illustrates top warp yarns 13, 15 and 19 (listed on the left-hand side) with warp yarns 11 and 17 being binding warp yarns and bottom warp yarns 14, 16 and 20 (listed on the left-hand side) with warp yarns 12 and 18 being binding warp yarns. The top and bottom weft yarns 1-18 are listed horizontally right to left.
Figure 2C:
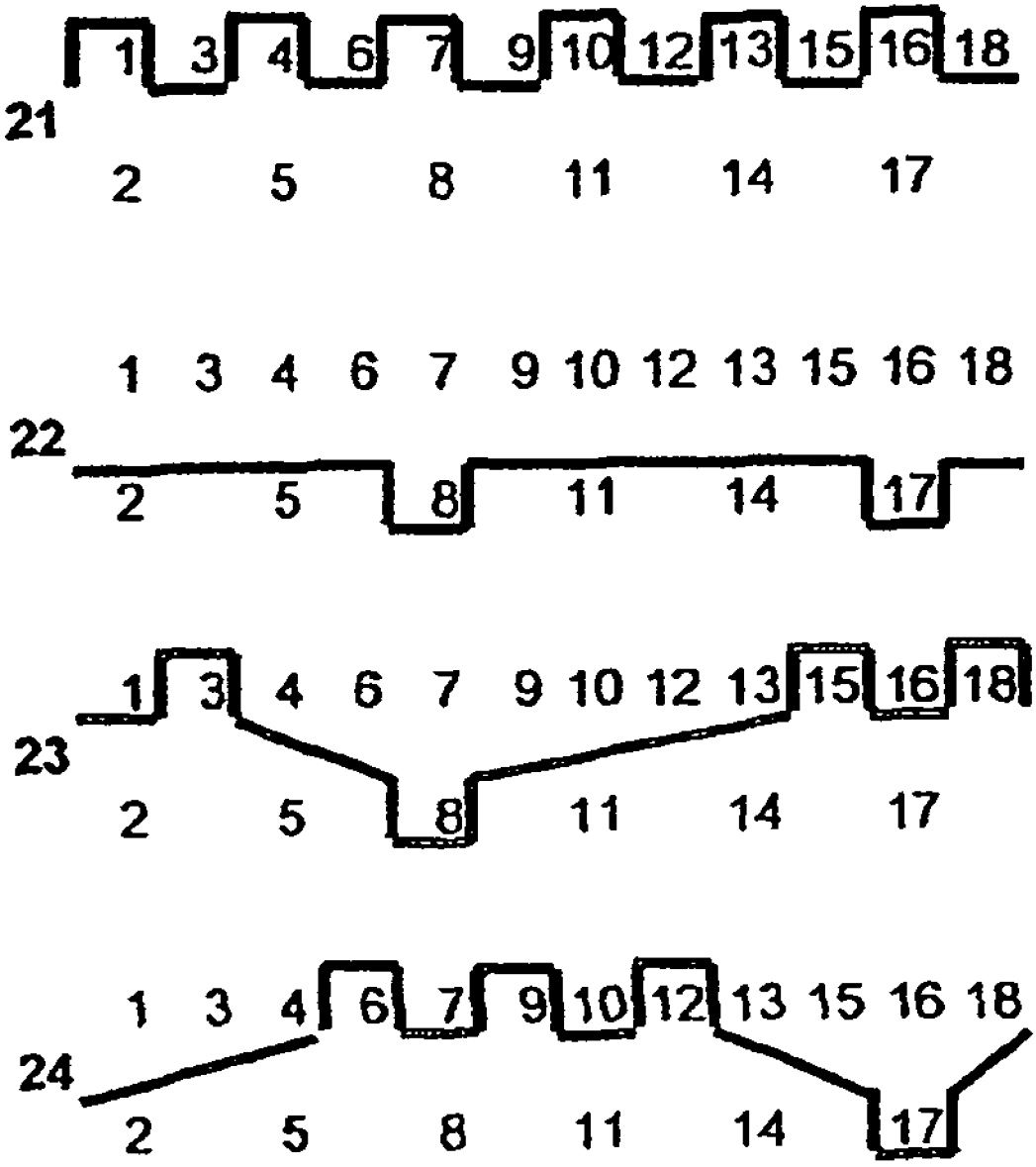
FIG. 2*c* shows a cross-section view of the repeat shown in FIG. 1 and illustrates top warp yarn 21 (listed on the left-hand side) with warp yarn 23 being a binding warp yarn and bottom warp yarn 22 (listed on the left-hand side) with warp yarn 24 being a binding warp yarn. The top and bottom weft yarns 1-18 are listed horizontally right to left.

FIGS. 2*a*-2*c* depict the paths of the upper and lower warp (including binding warp) yarns 1-24 as they weave through the upper and lower weft yarns 1-18. The fabric of FIG. 1 thus shows a single repeat of the fabric that encompasses 18 weft yarns (yarns 1-18 represented horizontally in the figures) and 24 warp yarns (yarns 1-24 represented vertically in the figures). While FIGS. 1-2*c* only show a single repeat unit of the fabric, those of skill in the art will appreciate that in commercial applications, the repeat unit shown in FIGS. 1-2*c* would be repeated many times, in both the warp and weft directions, to form a large fabric suitable for use on a papermaking machine.

As seen in FIG. 2*a*, top warp yarn 1 weaves with a plain weave with top weft yarns 1, 3, 4, 6, 7, 9, 10, 12, 13, 15 and 18 by passing over top weft yarns 1, 4, 7, 10, 13 and 16 and passing under top weft yarns 3, 6, 9, 12, 15 and 18. The top warp yarn 1 thus weaves only in the top layer.

Also seen in FIG. 2, bottom warp yarn 2 passes over bottom weft yarn 2, then passes under bottom weft yarns 5 and 8, then passes over bottom weft yarn 11, then passes under bottom weft yarns 14 and 17. The bottom warp yarn 2 thus weaves only in the bottom layer.

FIG. 2*a* also illustrates top warp yarn 3 weaving with a plain weave with top weft yarns 1, 3, 4, 6, 7, 9, 10, 12, 13, 15 and 18 by passing over top weft yarns 3, 6, 9, 12, 15 and 18 and passing under top weft yarns 1, 4, 7, 10, 13 and 16. The top warp yarn 3 thus weaves only in the top layer.

FIG. 2*a* additionally illustrates bottom warp yarn 4 passing over bottom weft yarn 2, then passes under bottom weft yarns 5 and 8, then passes over bottom weft yarn 11, then passes under bottom weft yarns 14 and 17. The bottom warp yarn 4 thus weaves only in the bottom layer. The bottom warp yarn 4 has the same weave path as the bottom warp yarn 2.

FIG. 2*a* further illustrates binding warp yarn 5 weaving with the top weft yarns 1, 3, 4, 6 and 7 to form a plain weave, then passes from the top layer to the bottom layer by passing under top weft yarns 9, 10 and 12, then passes over bottom weft yarn 14, then passes from the bottom layer to the top layer by passing under top weft yarns 15, 16 and 18. The binding warp yarn 5 thus weaves in the top layer and binds to the bottom layer by binding with one bottom weft yarn, e.g., by passing over bottom weft yarn 14.

FIG. 2*a* also illustrates binding warp yarn 6 passing from the top layer to the bottom layer by passing under top weft yarns 1 and 3, then passes over bottom weft yarn 5, then passes from the bottom layer to the top layer by passing under top weft yarns 6, 7 and 9, then weaves with top weft yarns 10, 12, 13, 15 and 16 with a plain weave, and then begins to pass back to the bottom layer by passing under top weft yarn 18. The binding warp yarn 6 thus weaves in the top layer and binds to the bottom layer by binding with one bottom weft yarn, e.g., by passing over bottom weft yarn 5. The top and bottom warp yarns 5 and 6 are exchanging warp yarns.

FIG. 2*a* further shows top warp yarn 7 weaving with a plain weave with top weft yarns 1, 3, 4, 6, 7, 9, 10, 12, 13, 15 and 18 by passing over top weft yarns 3, 6, 9, 12, 15 and 18 and passing under top weft yarns 1, 4, 7, 10, 13 and 16. The top warp yarn 7 thus weaves only in the top layer.

Moreover, FIG. 2*a* shows bottom warp yarn 8 passing under bottom weft yarn 2, then passes over bottom weft yarn 5, then passes under bottom weft yarns 8 and 11, then passes over bottom weft yarn 14, and then passes under bottom weft yarn 17. The bottom warp yarn 8 thus weaves only in the bottom layer.

FIG. 2*a* additionally shows top warp yarn 9 weaving with a plain weave with top weft yarns 1, 3, 4, 6, 7, 9, 10, 12, 13, 15 and 18 by passing over top weft yarns 1, 4, 7, 10, 13 and 16 and passing under top weft yarns 3, 6, 9, 12, 15 and 18. The top warp yarn 9 thus weaves only in the top layer.

Finally, FIG. 2*a* shows bottom warp yarn 10 passing under bottom weft yarns 2 and 5, then passes over bottom weft yarn 8, then passes under bottom weft yarns 11 and 14, then passes over bottom weft yarn 17. The bottom warp yarn 10 thus weaves only in the bottom layer.

With reference to FIG. 2*b*, binding warp yarn 11 passes from the bottom layer to the top layer by passing under top weft yarns 1, 3 and 4, then weaves with the top weft yarns 6, 7, 9, 10 and 12 to form a plain weave, then passes from the top layer to the bottom layer by passing under top weft yarns 13 and 15, then passes over bottom weft yarn 17, then passes from the bottom layer to the top layer by passing under top weft yarn 18. The binding warp yarn 11 thus weaves in the top layer and binds to the bottom layer by binding with one bottom weft yarn, e.g., by passing over bottom weft yarn 17.

FIG. 2*b* also illustrates binding warp yarn 12 weaving with top weft yarns 1 and 3 with a plain weave, then passes from the top layer to the bottom layer by passing under top weft yarns 4 and 6, then passes over bottom weft yarn 8, then passes from the bottom layer to the top layer by passing under top weft yarns 9, 10, 12 and 13, then weaves with the top weft yarns 15, 16, and 18 to form a plain weave. The binding warp yarn 12 thus weaves in the top layer and binds to the bottom layer by binding with one bottom weft yarn, e.g., by passing over bottom weft yarn 8. The top and bottom warp yarns 11 and 12 are exchanging warp yarns.

Also seen in FIG. 2*b*, top warp yarn 13 weaves with a plain weave with top weft yarns 1, 3, 4, 6, 7, 9, 10, 12, 13, 15 and 18 by passing over top weft yarns 1, 4, 7, 10, 13 and 16 and passing under top weft yarns 3, 6, 9, 12, 15 and 18. The top warp yarn 13 thus weaves only in the top layer.

FIG. 2*b* also shows bottom warp yarn 14 passing over bottom weft yarn 2, then passes under bottom weft yarns 5 and 8, then passes over bottom weft yarn 11, then passes under bottom weft yarns 14 and 17. The bottom warp yarn 14 thus weaves only in the bottom layer. The bottom warp yarn 14 has the same weave path as the bottom warp yarns 2, 4 and 16.

FIG. 2*b* additionally illustrates top warp yarn 15 weaving with a plain weave with top weft yarns 1, 3, 4, 6, 7, 9, 10, 12, 13, 15 and 18 by passing over top weft yarns 3, 6, 9, 12, 15 and 18 and passing under top weft yarns 1, 4, 7, 10, 13 and 16. The top warp yarn 15 thus weaves only in the top layer.

Also seen in FIG. 2*b*, bottom warp yarn 16 passes over bottom weft yarn 2, then passes under bottom weft yarns 5 and 8, then passes over bottom weft yarn 11, then passes under bottom weft yarns 14 and 17. The bottom warp yarn 16 thus weaves only in the bottom layer. The bottom warp yarn 16 has the same weave path as the bottom warp yarns 2, 4 and 14.

FIG. 2*b* also illustrates binding warp yarn 17 passing from the top layer to the bottom layer by passing under top weft yarns 1 and 3, then passes over bottom weft yarn 5, then passes from the bottom layer to the top layer by passing under top weft yarns 6, 7 and 9, then weaves with top weft yarns 10, 12, 13, 15 and 16 with a plain weave, and then begins to pass back to the bottom layer by passing under top weft yarn 18. The binding warp yarn 17 thus weaves in the top layer and binds to the bottom layer by binding with one bottom weft yarn, e.g., by passing over bottom weft yarn 5.

Moreover, FIG. 2*b* illustrates binding warp yarn 18 weaving with the top weft yarns 1, 3, 4, 6 and 7 to form a plain weave, then passes from the top layer to the bottom layer by passing under top weft yarns 9, 10 and 12, then passes over bottom weft yarn 14, then passes from the bottom layer to the top layer by passing under top weft yarns 15, 16 and 18. The binding warp yarn 18 thus weaves in the top layer and binds to the bottom layer by binding with one bottom weft yarn, e.g., by passing over bottom weft yarn 14. The top and bottom warp yarns 17 and 18 are exchanging warp yarns.

FIG. 2*b* further shows top warp yarn 19 weaving with a plain weave with top weft yarns 1, 3, 4, 6, 7, 9, 10, 12, 13, 15 and 18 by passing over top weft yarns 3, 6, 9, 12, 15 and 18 and passing under top weft yarns 1, 4, 7, 10, 13 and 16. The top warp yarn 19 thus weaves only in the top layer.

Finally, FIG. 2*b* shows bottom warp yarn 20 passing under bottom weft yarn 2, then passes over bottom weft yarn 5, then passes under bottom weft yarns 8 and 11, then passes over bottom weft yarn 14, and then passes under bottom weft yarn 17. The bottom warp yarn 20 thus weaves only in the bottom layer.

With reference to FIG. 2*c*, top warp yarn 21 weaving with a plain weave with top weft yarns 1, 3, 4, 6, 7, 9, 10, 12, 13, 15 and 18 by passing over top weft yarns 1, 4, 7, 10, 13 and 16 and passing under top weft yarns 3, 6, 9, 12, 15 and 18. The top warp yarn 21 thus weaves only in the top layer.

Also seen in FIG. 2*c*, bottom warp yarn 22 passes under bottom weft yarns 2 and 5, then passes over bottom weft yarn 8, then passes under bottom weft yarns 11 and 14, then passes over bottom weft yarn 17. The bottom warp yarn 22 thus weaves only in the bottom layer.

FIG. 2*c* also illustrates binding warp yarn 23 weaving with top weft yarns 1 and 3 with a plain weave, then passes from the top layer to the bottom layer by passing under top weft yarns 4 and 6, then passes over bottom weft yarn 8, then passes from the bottom layer to the top layer by passing under top weft yarns 9, 10, 12 and 13, then weaves with the top weft yarns 15, 16, and 18 to form a plain weave. The binding warp yarn 23 thus weaves in the top layer and binds to the bottom layer by binding with one bottom weft yarn, e.g., by passing over bottom weft yarn 8.

Finally, FIG. 2*c* shows binding warp yarn 24 passing from the bottom layer to the top layer by passing under top weft yarns 1, 3 and 4, then weaves with the top weft yarns 6, 7, 9, 10 and 12 to form a plain weave, then passes from the top layer to the bottom layer by passing under top weft yarns 13 and 15, then passes over bottom weft yarn 17, then passes from the bottom layer to the top layer by passing under top weft yarn 18. The binding warp yarn 24 thus weaves in the top layer and binds to the bottom layer by binding with one bottom weft yarn, e.g., by passing over bottom weft yarn 17. The top and bottom warp yarns 23 and 24 are exchanging warp yarns.

By way of non-limiting example, the top (including binding) warp yarns 1, 3, 5, 7, 9, 11, 13, 15, 17, 19, 21 and 23 of the embodiment shown in FIGS. 1-2*c* can have the following characteristics: acceptable size range of between approximately 0.10 mm and approximately 0.50 mm, preferable size ranges of between approximately 0.20 mm and approximately 0.80 mm, and most preferred size range of between approximately 0.12 mm and approximately 0.20 mm. The material for these yarns can be any natural or synthetic material, preferably a synthetic monofilament, and most preferably a polyester monofilament.

By way of non-limiting example, the bottom (including binding) warp yarns 2, 4, 6, 8, 10, 12, 14, 16, 18, 20, 22 and 24 of the embodiment shown in FIGS. 1-2*c* can have the following characteristics: acceptable size range of between approximately 0.15 mm and approximately 0.60 mm, preferable size ranges of between approximately 0.20 mm and approximately 0.40 mm, and most preferred size range of between approximately 0.25 mm and approximately 0.35 mm. The material for these yarns can be any natural or synthetic material, preferably a synthetic monofilament, and most preferably a polyester monofilament. The bottom warp yarns can preferably be constructed using relatively large diameter yarns that are well suited to sustain the wear caused by the friction between the machine side surface of the fabric and the papermaking machine during use of the fabric.

By way of non-limiting example, the top weft yarns 1, 3, 4, 6, 7, 9, 10, 12, 13, 15, 16 and 18 of the embodiment shown in FIGS. 1-2*c* can have the following characteristics: acceptable size range of between approximately 0.10 mm and approximately 0.50 mm, preferable size ranges of between approximately 0.20 mm and approximately 0.80 mm, and most preferred size range of between approximately 0.12 mm and approximately 0.80 mm. The material for these yarns can be any natural or synthetic material, preferably a synthetic monofilament, and most preferably a polyester monofilament.

By way of non-limiting example, the bottom weft yarns 2, 5, 8, 11, 14 and 17 of the embodiment shown in FIGS. 1-2*c* can have the following characteristics: acceptable size range of between approximately 0.15 mm and approximately 0.60 mm, preferable size ranges of between approximately 0.20 mm and approximately 0.40 mm, and most preferred size range of between approximately 0.25 mm and approximately 0.35 mm. The material for these yarns can be any natural or synthetic material, preferably a synthetic monofilament, and most preferably a polyester monofilament. These bottom weft yarns may also be constructed using larger diameter yarns than the upper warp yarns.

In the embodiment shown in FIGS. 1-2*c* all of the non-exchanging top warp yarns form a plain weave in the top layer. All of the exchanging top and bottom pairs also weave in the top layer with a plain weave and bind with one bottom weft yarn. Furthermore, all of the non-exchanging bottom warp yarns weave only in the bottom layer. When a top warp yarn passes from the top layer to the bottom layer, it passes under at least two adjacent top weft yarns before binding with the bottom layer. When a bottom warp yarn passes from the bottom layer to the top layer, it passes under at least three adjacent top weft yarns before weaving with the top layer. Finally, the pattern repeat utilizes four exchanging top and bottom warp pairs and eight non-exchanging top and bottom warp pairs. At least three of the exchanging warp pairs have two adjacent non-exchanging pairs on both sides of each exchanging warp pairs. Thus, the repeat has the following configuration of warp pairs: a pair of non-exchanging warp yarns 1 and 2 followed by another pair of non-exchanging warp yarns 3 and 4, and then followed by a pair of exchanging warp yarns 5 and 6; followed by a pair of non-exchanging warp yarns 7 and 8 followed by another pair of non-exchanging warp yarns 9 and 10, and then followed by a pair of exchanging warp yarns 11 and 12; followed by a pair of non-exchanging warp yarns 13 and 14 followed by another pair of non-exchanging warp yarns 15 and 16, and then followed by a pair of exchanging warp yarns 17 and 18; and followed by a pair of non-exchanging warp yarns 19 and 20 followed by another pair of non-exchanging warp yarns 21 and 22, and then followed by a pair of exchanging warp yarns 23 and 24. These features are desirable in numerous papermaking applications.

FIG. 3 shows a second non-limiting embodiment of the invention and depicts a top pattern view of the top fabric layer of the multilayer fabric (i.e., a view of the papermaking surface) and utilizing the symbols as defined above. The numbers 1-24 shown on the bottom of the pattern identify the upper and lower warp (including binding warp) yarns while the right side numbers 1-36 show the upper or top and lower or bottom weft yarns. The upper or top warp (including binding warp) yarns shown on the bottom of the pattern are 1, 3, 5, 7, 9, 11, 13, 15, 17, 19, 21 and 23. The lower or bottom warp (including binding warp) yarns shown on the bottom of the pattern are 2, 4, 6, 8, 10, 12, 14, 16, 18, 20, 22 and 24. The upper or top weft yarns shown on the right side of the pattern are 1, 3, 4, 6, 7, 9, 10, 12, 13, 15, 16, 18, 19, 21, 22, 24, 25, 27, 28, 30, 31, 33, 34 and 36. The lower or bottom weft yarns shown on the right side of the pattern are 2, 5, 8, 11, 14, 17, 20, 23, 26, 29, 32 and 35.

Figure 4A:
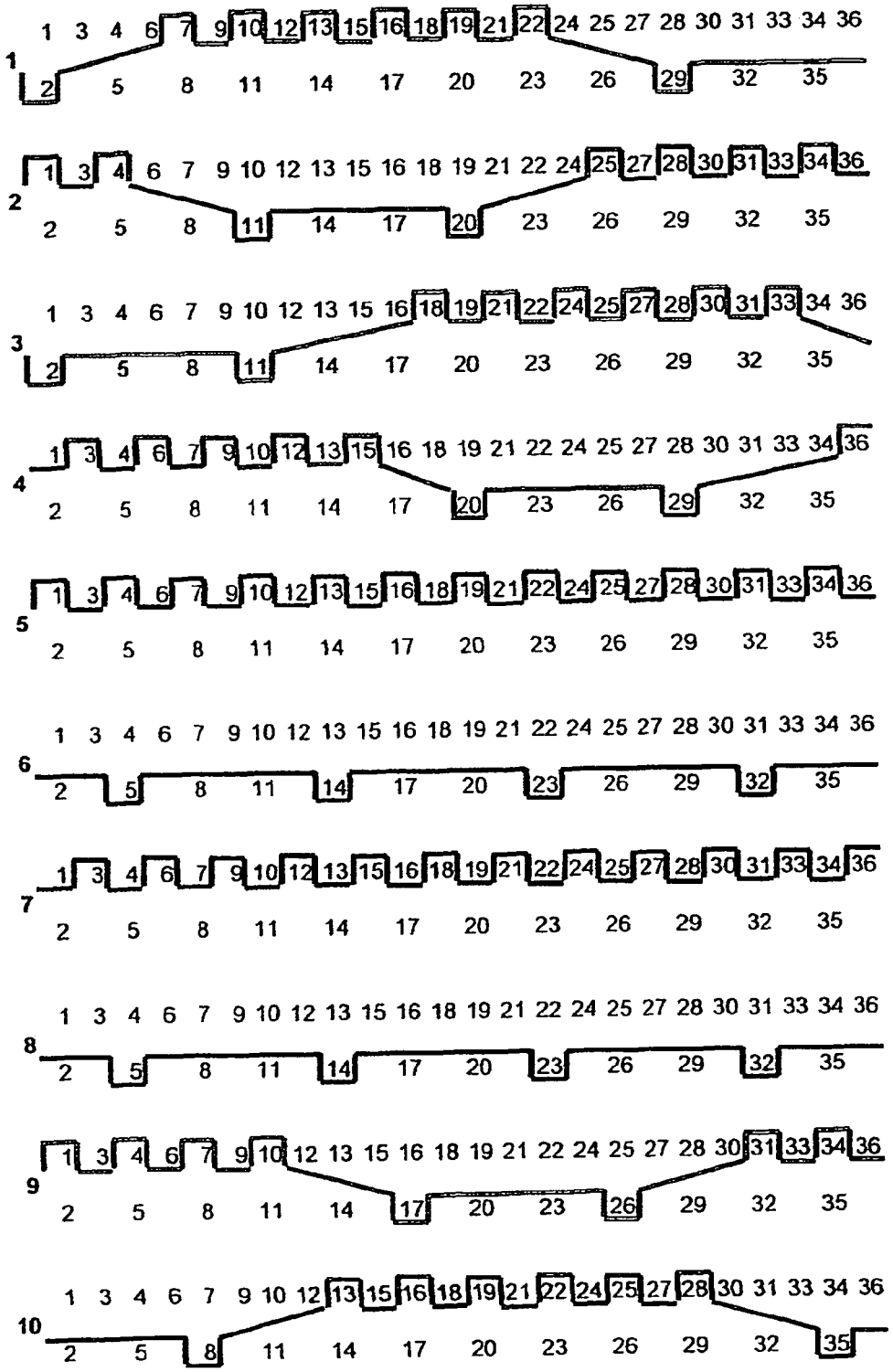
FIG. 4*a* shows a cross-section view of the repeat shown in FIG. 3 and illustrates top warp yarns 5 and 7 (listed on the left-hand side) with warp yarns 1, 3 and 9 being a binding warp yarns and bottom warp yarns 6 and 8 (listed on the left-hand side) with warp yarns 2, 4 and 10 being a binding warp yarns. The top and bottom weft yarns 1-36 are listed horizontally right to left.
Figure 4B:
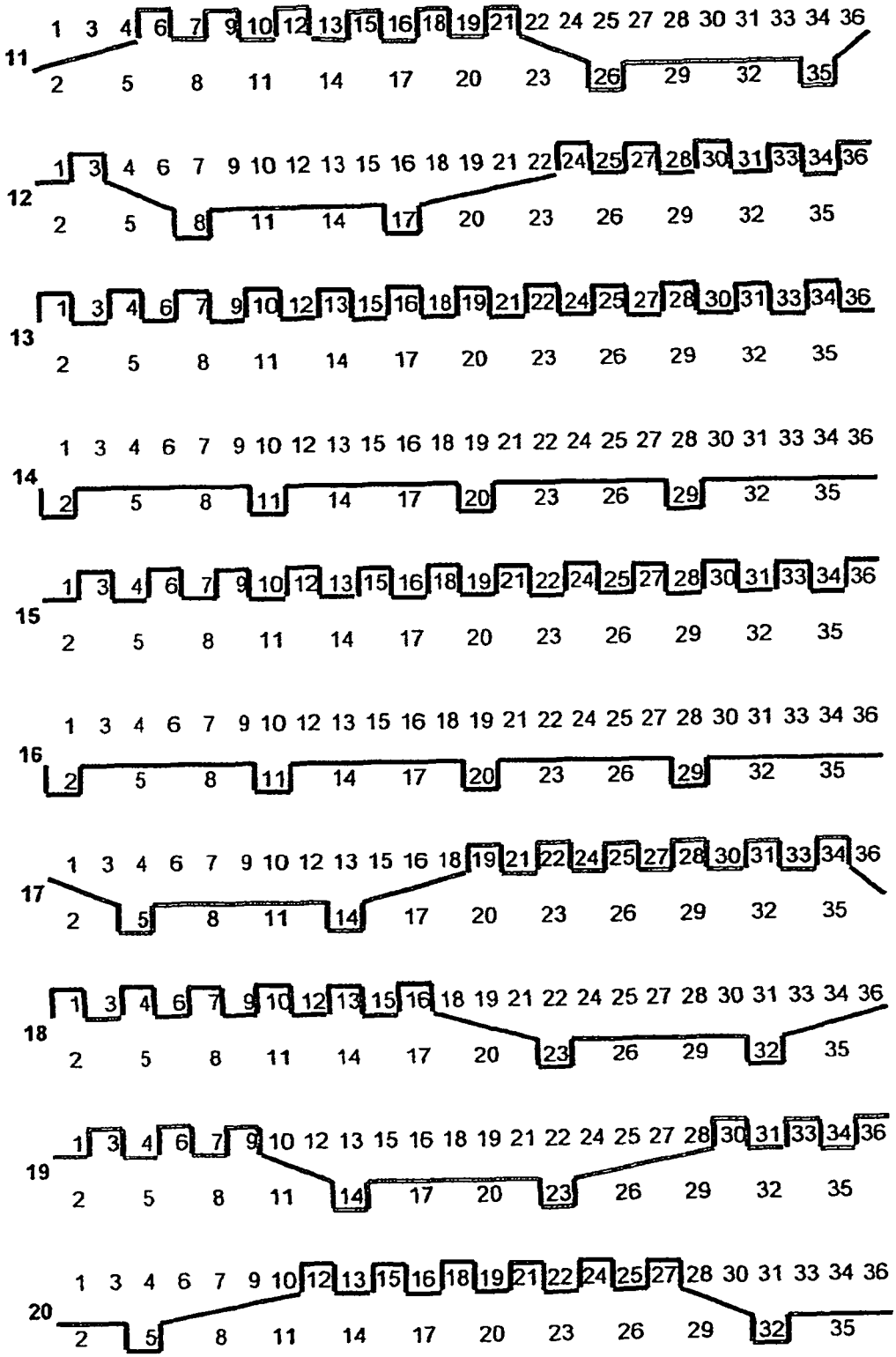
FIG. 4*b* shows a cross-section view of the repeat shown in FIG. 3 and illustrates top warp yarns 13 and 15 (listed on the left-hand side) with warp yarns 11, 17 and 19 being a binding warp yarns and bottom warp yarns 14 and 16 (listed on the left-hand side) with warp yarns 12, 18 and 20 being a binding warp yarns. The top and bottom weft yarns 1-36 are listed horizontally right to left.
Figure 4C:
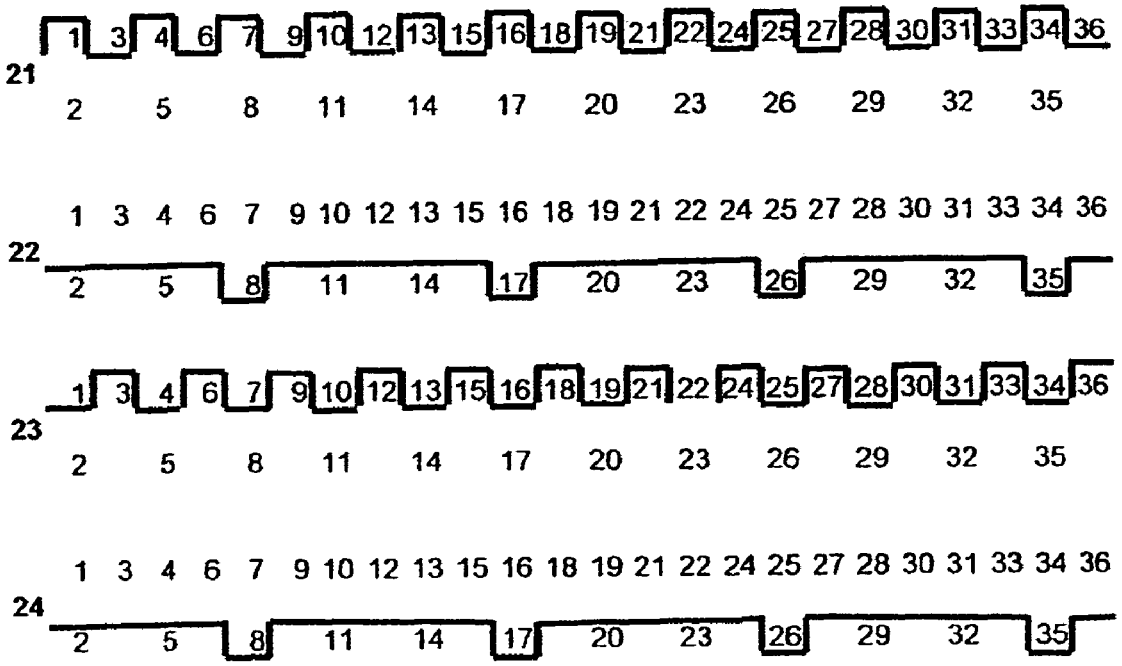
FIG. 4*c* shows a cross-section view of the repeat shown in FIG. 3 and illustrates top warp yarns 21 and 23 (listed on the left-hand side) and bottom warp yarns 22 and 24 (listed on the left-hand side). The top and bottom weft yarns 1-36 are listed horizontally right to left.

FIGS. 4*a*-4*c* depict the paths of the upper and lower warp (including binding warp) yarns 1-24 as they weave through the upper and lower weft yarns 1-36. The fabric of FIG. 3 thus shows a single repeat of the fabric that encompasses 36 weft yarns (yarns 1-36 represented horizontally in the figures) and 24 warp yarns (yarns 1-24 represented vertically in the figures). While FIGS. 3-4*c* only show a single repeat unit of the fabric, those of skill in the art will appreciate that in commercial applications, the repeat unit shown in FIGS. 3-4*c* would be repeated many times, in both the warp and weft directions, to form a large fabric suitable for use on a papermaking machine.

With reference to FIG. 4*a*, binding warp yarn 1 passes over bottom weft yarn 2, then passes from the bottom layer to the top layer by passing under top weft yarns 3, 4 and 6, then weaves with the top weft yarns 7, 9, 10, 12, 13, 15, 16, 18, 19, 21 and 22 to form a plain weave, then passes from the top layer to the bottom layer by passing under top weft yarns 24, 25 and 27, then passes over bottom weft yarn 29, then passes under bottom weft yarns 32 and 35. The binding warp yarn 1 thus weaves in the top layer and binds to the bottom layer by binding with two non-adjacent bottom weft yarns, e.g., by passing over bottom weft yarns 2 and 29.

FIG. 4*a* also illustrates binding warp yarn 2 weaving with top weft yarns 1, 3 and 4 with a plain weave, then passes from the top layer to the bottom layer by passing under top weft yarns 6, 7 and 9, then passes over bottom weft yarn 11, then passes under bottom weft yarns 14 and 17, then passes over bottom weft yarn 20, then passes from the bottom layer to the top layer by passing under top weft yarns 21, 22 and 24, then weaves with the top weft yarns 25, 27, 28, 30, 31, 33, 34 and 36 to form a plain weave. The binding warp yarn 2 thus weaves in the top layer and binds to the bottom layer by binding with two non-adjacent bottom weft yarns, e.g., by passing over bottom weft yarns 11 and 20. The top and bottom warp yarns 1 and 2 are exchanging warp yarns.

Again with reference to FIG. 4*a*, binding warp yarn 3 passing over bottom weft yarn 2, then passes under bottom weft yarns 5 and 8, then passes over bottom weft yarn 11, then passes from the bottom layer to the top layer by passing under top weft yarns 12, 13, 15 and 16, then weaves with the top weft yarns 18, 19, 21, 22, 24, 25, 27, 28, 30, 31 and 33 to form a plain weave, then passes from the top layer to the bottom layer by passing under top weft yarns 34 and 36. The binding warp yarn 3 thus weaves in the top layer and binds to the bottom layer by binding with two non-adjacent bottom weft yarns, e.g., by passing over bottom weft yarns 2 and 11.

FIG. 4*a* additionally shows binding warp yarn 4 weaving with top weft yarns 1, 3, 4, 6, 7, 9, 10, 12, 13 and 15 with a plain weave, then passes from the top layer to the bottom layer by passing under top weft yarns 16 and 18, then passes over bottom weft yarn 20, then passes under bottom weft yarns 23 and 26, then passes over bottom weft yarn 29, then passes from the bottom layer to the top layer by passing under top weft yarns 30, 31, 33 and 34, then weaves with the top weft yarn 36. The binding warp yarn 4 thus weaves in the top layer and binds to the bottom layer by binding with two non-adjacent bottom weft yarns, e.g., by passing over bottom weft yarns 20 and 29. The top and bottom warp yarns 3 and 4 are exchanging warp yarns.

Also seen in FIG. 4*a* top warp yarn 5 weaves with a plain weave with top weft yarns 1, 3, 4, 6, 7, 9, 10, 12, 13, 15, 16, 18, 19, 21, 22, 24, 25, 27, 28, 30, 31, 33, 34 and 36 by passing over top weft yarns 1, 4, 7, 10, 13, 16, 19, 22, 25, 28, 31 and 34 and passing under top weft yarns 3, 6, 9, 12, 15, 18, 21, 24, 27, 30, 33 and 36. The top warp yarn 5 thus weaves only in the top layer.

FIG. 4*a* also illustrates bottom warp yarn 6 passing under bottom weft yarn 2, then passes over bottom weft yarn 5, then passes under bottom weft yarns 8 and 11, then passes over bottom weft yarn 14, passes under bottom weft yarns 17 and 20, then passes over bottom weft yarn 23, then passes under bottom weft yarns 26 and 29, then passes over bottom weft yarn 32, then passes under bottom weft yarn 35. The bottom warp yarn 6 thus weaves only in the bottom layer.

Moreover, FIG. 4*a* shows top warp yarn 7 weaving with a plain weave with top weft yarns 1, 3, 4, 6, 7, 9, 10, 12, 13, 15, 16, 18, 19, 21, 22, 24, 25, 27, 28, 30, 31, 33, 34 and 36 by passing over top weft yarns 3, 6, 9, 12, 15, 18, 21, 24, 27, 30, 33 and 36 and passing under top weft yarns 1, 4, 7, 10, 13, 16, 19, 22, 25, 28, 31 and 34. The top warp yarn 7 thus weaves only in the top layer.

FIG. 4*a* also illustrates bottom warp yarn 8 passing under bottom weft yarn 2, then passes over bottom weft yarn 5, then passes under bottom weft yarns 8 and 11, then passes over bottom weft yarn 14, passes under bottom weft yarns 17 and 20, then passes over bottom weft yarn 23, then passes under bottom weft yarns 26 and 29, then passes over bottom weft yarn 32, then passes under bottom weft yarn 35. The bottom warp yarn 8 thus weaves only in the bottom layer. Moreover, the path followed by the bottom warp yarn 8 is the same as the path followed by bottom warp yarn 6.

Also seen in FIG. 4*a*, binding warp yarn 9 weaves with top weft yarns 1, 3, 4, 6, 7, 9 and 10 with a plain weave, then passes from the top layer to the bottom layer by passing under top weft yarns 12, 13 and 15, then passes over bottom weft yarn 17, then passes under bottom weft yarns 20 and 23, then passes over bottom weft yarn 26, then passes from the bottom layer to the top layer by passing under top weft yarns 27, 28 and 30, then weaves with the top weft yarns 31, 33, 34 and 36. The binding warp yarn 9 thus weaves in the top layer and binds to the bottom layer by binding with two non-adjacent bottom weft yarns, e.g., by passing over bottom weft yarns 17 and 26.

Finally, FIG. 4*a* shows binding warp yarn 10 passing under bottom weft yarns 2 and 5, then passes over bottom weft yarn 8, then passes from the bottom layer to the top layer by passing under top weft yarns 9, 10 and 12, then weaves with the top weft yarns 13, 15, 16, 18, 19, 21, 22, 24, 25, 27 and 28 to form a plain weave, then passes from the top layer to the bottom layer by passing under top weft yarns 30, 31 and 33, then passes over bottom weft yarn 35. The binding warp yarn 10 thus weaves in the top layer and binds to the bottom layer by binding with two non-adjacent bottom weft yarns, e.g., by passing over bottom weft yarns 8 and 35.

With reference to FIG. 4*b*, binding warp yarn 11 passes from the bottom layer to the top layer by passing under top weft yarns 1, 3 and 4, then weaves with the top weft yarns 6, 7, 9, 10, 12, 13, 15, 16, 18, 19 and 21 to form a plain weave, then passes from the top layer to the bottom layer by passing under top weft yarns 22 and 24, then passes over bottom weft yarn 26, then passes under bottom weft yarns 29 and 32, then passes over bottom weft yarn 35, and then begins to pass from the bottom layer to the top layer by passing under top weft yarn 36. The binding warp yarn 11 thus weaves in the top layer and binds to the bottom layer by binding with two non-adjacent bottom weft yarns, e.g., by passing over bottom weft yarns 26 and 35.

Also seen in FIG. 4*b*, binding warp yarn 12 weaves with top weft yarns 1 and 3 with a plain weave, then passes from the top layer to the bottom layer by passing under top weft yarns 4 and 6, then passes over bottom weft yarn 8, then passes under bottom weft yarns 11 and 14, then passes over bottom weft yarn 17, then passes from the bottom layer to the top layer by passing under top weft yarns 18, 19, 21 and 22, then weaves with the top weft yarns 24, 25, 27, 28, 30, 31, 33, 34 and 36 to form a plain weave. The binding warp yarn 12 thus weaves in the top layer and binds to the bottom layer by binding with two non-adjacent bottom weft yarns, e.g., by passing over bottom weft yarns 8 and 17. The top and bottom warp yarns 11 and 12 are exchanging warp yarns.

FIG. 4*b* also illustrates top warp yarn 13 weaving with a plain weave with top weft yarns 1, 3, 4, 6, 7, 9, 10, 12, 13, 15, 16, 18, 19, 21, 22, 24, 25, 27, 28, 30, 31, 33, 34 and 36 by passing over top weft yarns 1, 4, 7, 10, 13, 16, 19, 22, 25, 28, 31 and 34 and passing under top weft yarns 3, 6, 9, 12, 15, 18, 21, 24, 27, 30, 33 and 36. The top warp yarn 13 thus weaves only in the top layer.

Also shown in FIG. 4*b*, bottom warp yarn 14 passes over bottom weft yarn 2, then passes under bottom weft yarns 5 and 8, then passes over bottom weft yarn 11, then passes under bottom weft yarns 14 and 17, then passes over bottom weft yarn 20, passes under bottom weft yarns 23 and 26, then passes over bottom weft yarn 29, and then passes under bottom weft yarns 32 and 35. The bottom warp yarn 14 thus weaves only in the bottom layer.

FIG. 4*b* also illustrates top warp yarn 15 weaving with a plain weave with top weft yarns 1, 3, 4, 6, 7, 9, 10, 12, 13, 15, 16, 18, 19, 21, 22, 24, 25, 27, 28, 30, 31, 33, 34 and 36 by passing over top weft yarns 3, 6, 9, 12, 15, 18, 21, 24, 27, 30, 33 and 36 and passing under top weft yarns 1, 4, 7, 10, 13, 16, 19, 22, 25, 28, 31 and 34. The top warp yarn 15 thus weaves only in the top layer.

FIG. 4*b* additionally shows bottom warp yarn 16 passing over bottom weft yarn 2, then passes under bottom weft yarns 5 and 8, then passes over bottom weft yarn 11, then passes under bottom weft yarns 14 and 17, then passes over bottom weft yarn 20, passes under bottom weft yarns 23 and 26, then passes over bottom weft yarn 29, and then passes under bottom weft yarns 32 and 35. The bottom warp yarn 16 thus weaves only in the bottom layer. Moreover, the path followed by the bottom warp yarn 16 is the same as the path followed by bottom warp yarn 14.

Also seen in FIG. 4*b*, binding warp yarn 17 passes from the top layer to the bottom layer by passing under top weft yarns 1 and 3, then passes over bottom weft yarn 5, then passes under bottom weft yarns 8 and 11, then passes over bottom weft yarn 14, then passes from the bottom layer to the top layer by passing under top weft yarns 15, 16 and 18, then weaves with the top weft yarns 19, 21, 22, 24, 25, 27, 28, 30, 31, 33 and 34 to form a plain weave, then begins to pass from the top layer to the bottom layer by passing under top weft yarn 36. The binding warp yarn 17 thus weaves in the top layer and binds to the bottom layer by binding with two non-adjacent bottom weft yarns, e.g., by passing over bottom weft yarns 5 and 14.

FIG. 4*b* further illustrates binding warp yarn 18 weaving with top weft yarns 1, 3, 4, 6, 7, 9, 10, 12, 13, 15 and 16 with a plain weave, then passes from the top layer to, the bottom layer by passing under top weft yarns 18, 19 and 21, then passes over bottom weft yarn 23, then passes under bottom weft yarns 26 and 29, then passes over bottom weft yarn 32, then passes from the bottom layer to the top layer by passing under top weft yarns 33, 34 and 36. The binding warp yarn 18 thus weaves in the top layer and binds to the bottom layer by binding with two non-adjacent bottom weft yarns, e.g., by passing over bottom weft yarns 23 and 32. The top and bottom warp yarns 17 and 18 are exchanging warp yarns.

Also seen in FIG. 4*b*, binding warp yarn 19 weaves with top weft yarns 1, 3, 4, 6, 7 and 9 with a plain weave, then passes from the top layer to the bottom layer by passing under top weft yarns 10 and 12, then passes over bottom weft yarn 14, then passes under bottom weft yarns 17 and 20, then passes over bottom weft yarn 23, then passes from the bottom layer to the top layer by passing under top weft yarns 24, 25, 27 and 28, then weaves with the top weft yarns 30, 31, 33, 34 and 36. The binding warp yarn 19 thus weaves in the top layer and binds to the bottom layer by binding with two non-adjacent bottom weft yarns, e.g., by passing over bottom weft yarns 14 and 23.

Finally, FIG. 4*b* shows binding warp yarn 20 passing under bottom weft yarn 2, then passes over bottom weft yarn 5, then passes from the bottom layer to the top layer by passing under top weft yarns 6, 7, 9 and 10, then weaves with the top weft yarns 12, 13, 15, 16, 18, 19, 21, 22, 24, 25 and 27 to form a plain weave, then passes from the top layer to the bottom layer by passing under top weft yarns 28 and 30, then passes over bottom weft yarn 32, and then passes under bottom weft yarn 35. The binding warp yarn 20 thus weaves in the top layer and binds to the bottom layer by binding with two non-adjacent bottom weft yarns, e.g., by passing over bottom weft yarns 5 and 32.

With reference to FIG. 4*c*, top warp yarn 21 weaves with a plain weave with top weft yarns 1, 3, 4, 6, 7, 9, 10, 12, 13, 15, 16, 18, 19, 21, 22, 24, 25, 27, 28, 30, 31, 33, 34 and 36 by passing over top weft yarns 1, 4, 7, 10, 13, 16, 19, 22, 25, 28, 31 and 34 and passing under top weft yarns 3, 6, 9, 12, 15, 18, 21, 24, 27, 30, 33 and 36. The top warp yarn 21 thus weaves only in the top layer.

Also seen in FIG. 4*c*, bottom warp yarn 22 passes under bottom weft yarns 2 and 5, then passes over bottom weft yarn 8, then passes under bottom weft yarns 11 and 14, then passes over bottom weft yarn 17, passes under bottom weft yarns 20 and 23, then passes over bottom weft yarn 26, then passes under bottom weft yarns 29 and 32, and then passes over bottom weft yarn 35. The bottom warp yarn 22 thus weaves only in the bottom layer.

FIG. 4*c* also illustrates top warp yarn 23 weaving with a plain weave with top weft yarns 1, 3, 4, 6, 7, 9, 10, 12, 13, 15, 16, 18, 19, 21, 22, 24, 25, 27, 28, 30, 31, 33, 34 and 36 by passing over top weft yarns 3, 6, 9, 12, 15, 18, 21, 24, 27, 30, 33 and 36 and passing under top weft yarns 1, 4, 7, 10, 13, 16, 19, 22, 25, 28, 31 and 34. The top warp yarn 23 thus weaves only in the top layer.

Finally, FIG. 4*c* shows bottom warp yarn 24 passing under bottom weft yarns 2 and 5, then passes over bottom weft yarn 8, then passes under bottom weft yarns 11 and 14, then passes over bottom weft yarn 17, passes under bottom weft yarns 20 and 23, then passes over bottom weft yarn 26, then passes under bottom weft yarns 29 and 32, and then passes over bottom weft yarn 35. The bottom warp yarn 24 thus weaves only in the bottom layer. Moreover, the path followed by the bottom warp yarn 24 is the same as the path followed by bottom warp yarn 22.

By way of non-limiting example, the top warp (including binding warp) yarns 1, 3, 5, 7, 9, 11, 13, 15, 17, 19, 21 and 23 of the embodiment shown in FIGS. 3-4*c* can have the following characteristics: acceptable size range of between approximately 0.10 mm and approximately 0.50 mm, preferable size ranges of between approximately 0.20 mm and approximately 0.80 mm, and most preferred size range of between approximately 0.12 mm and approximately 0.20 mm. The material for these yarns can be any natural or synthetic material, preferably a synthetic monofilament, and most preferably a polyester monofilament.

By way of non-limiting example, the bottom warp (including binding warp) yarns 2, 4, 6, 8, 10, 12, 14, 16, 18, 20, 22 and 24 of the embodiment shown in FIGS. 3-4*c* can have the following characteristics: acceptable size range of between approximately 0.15 mm and approximately 0.60 mm, preferable size ranges of between approximately 0.20 mm and approximately 0.40 mm, and most preferred size range of between approximately 0.25 mm and approximately 0.35 mm. The material for these yarns can be any natural or synthetic material, preferably a synthetic monofilament, and most preferably a polyester monofilament. The bottom warp yarns can preferably be constructed using relatively large diameter yarns that are well suited to sustain the wear caused by the friction between the machine side surface of the fabric and the papermaking machine during use of the fabric.

By way of non-limiting example, the top weft yarns 1, 3, 4, 6, 7, 9, 10, 12, 13, 15, 16, 18, 19, 21, 22, 24, 25, 27, 28, 30, 31, 33, 34 and 36 of the embodiment shown in FIGS. 3-4*c* can have the following characteristics: acceptable size range of between approximately 0.10 mm and approximately 0.50 mm, preferable size ranges of between approximately 0.20 mm and approximately 0.80 mm, and most preferred size range of between approximately 0.12 mm and approximately 0.80 mm. The material for these yarns can be any natural or synthetic material, preferably a synthetic monofilament, and most preferably a polyester monofilament.

By way of non-limiting example, the bottom weft yarns 2, 5, 8, 11, 14, 17, 20, 23, 26, 29, 32 and 35 of the embodiment shown in FIGS. 3-4*c* can have the following characteristics: acceptable size range of between approximately 0.15 mm and approximately 0.60 mm, preferable size ranges of between approximately 0.20 mm and approximately 0.40 mm, and most preferred size range of between approximately 0.25 mm and approximately 0.35 mm. The material for these yarns can be any natural or synthetic material, preferably a synthetic monofilament, and most preferably a polyester monofilament. These bottom weft yarns may also be constructed using larger diameter yarns than the upper warp yarns.

In the embodiment shown in FIGS. 3-4*c* all of the non-exchanging or top warp yarns form a plain weave in the top layer. All of the exchanging or binding warp pairs also weave in the top layer with a plain weave and bind with two non-adjacent bottom weft yarns. Furthermore, all of the non-exchanging bottom warp yarns weave only in the bottom layer. When a top warp yarns pass from the top layer to the bottom layer, it passes under at least two adjacent top weft yarns before binding with the bottom layer. When a bottom warp yarn passes from the bottom layer to the top layer, it passes under at least three adjacent top weft yarns before weaving with the top layer. Finally, the pattern repeat utilizes six exchanging top and bottom warp pairs and six non-exchanging top and bottom warp pairs. Thus, the repeat has the following configuration of warp pairs: a pair of exchanging warp yarns 1 and 2 followed by another pair of exchanging warp yarns 3 and 4, then followed by a pair of non-exchanging warp yarns 5 and 6, followed by another pair of non-exchanging warp yarns 7 and 8; then a pair of exchanging warp yarns 9 and 10 followed by another pair of exchanging warp yarns 11 and 12, then followed by a pair of non-exchanging warp yarns 13 and 14, followed by another pair of non-exchanging warp yarns 15 and 16; then a pair of exchanging warp yarns 17 and 18 followed by another pair of exchanging warp yarns 19 and 20, then followed by a pair of non-exchanging warp yarns 21 and 22, followed by another pair of non-exchanging warp yarns 23 and 24. These features are desirable in numerous papermaking applications.

FIG. 5 shows a third non-limiting embodiment of the invention and depicts a top pattern view of the top fabric layer of the multilayer fabric (i.e., a view of the papermaking surface) and utilizing the symbols defined above. The numbers 1-24 shown on the bottom of the pattern identify the upper and lower warp (including binding warp) yarns while the right side numbers 1-36 show the upper or top and lower or bottom weft yarns. The upper or top warp (including binding warp) yarns shown on the bottom of the pattern are 1, 3, 5, 7, 9, 11, 13, 15, 17, 19, 21 and 23. The lower or bottom warp (including binding warp) yarns shown on the bottom of the pattern are 2, 4, 6, 8, 10, 12, 14, 16, 18, 20, 22 and 24. The upper or top weft yarns shown on the right side of the pattern are 1, 3, 4, 6, 7, 9, 10, 12, 13, 15, 16, 18, 19, 21, 22, 24, 25, 27, 28, 30, 31, 33, 34 and 36. The lower or bottom weft yarns shown on the right side of the pattern are 2, 5, 8, 11, 14, 17, 20, 23, 26, 29, 32 and 35.

Figure 6A:
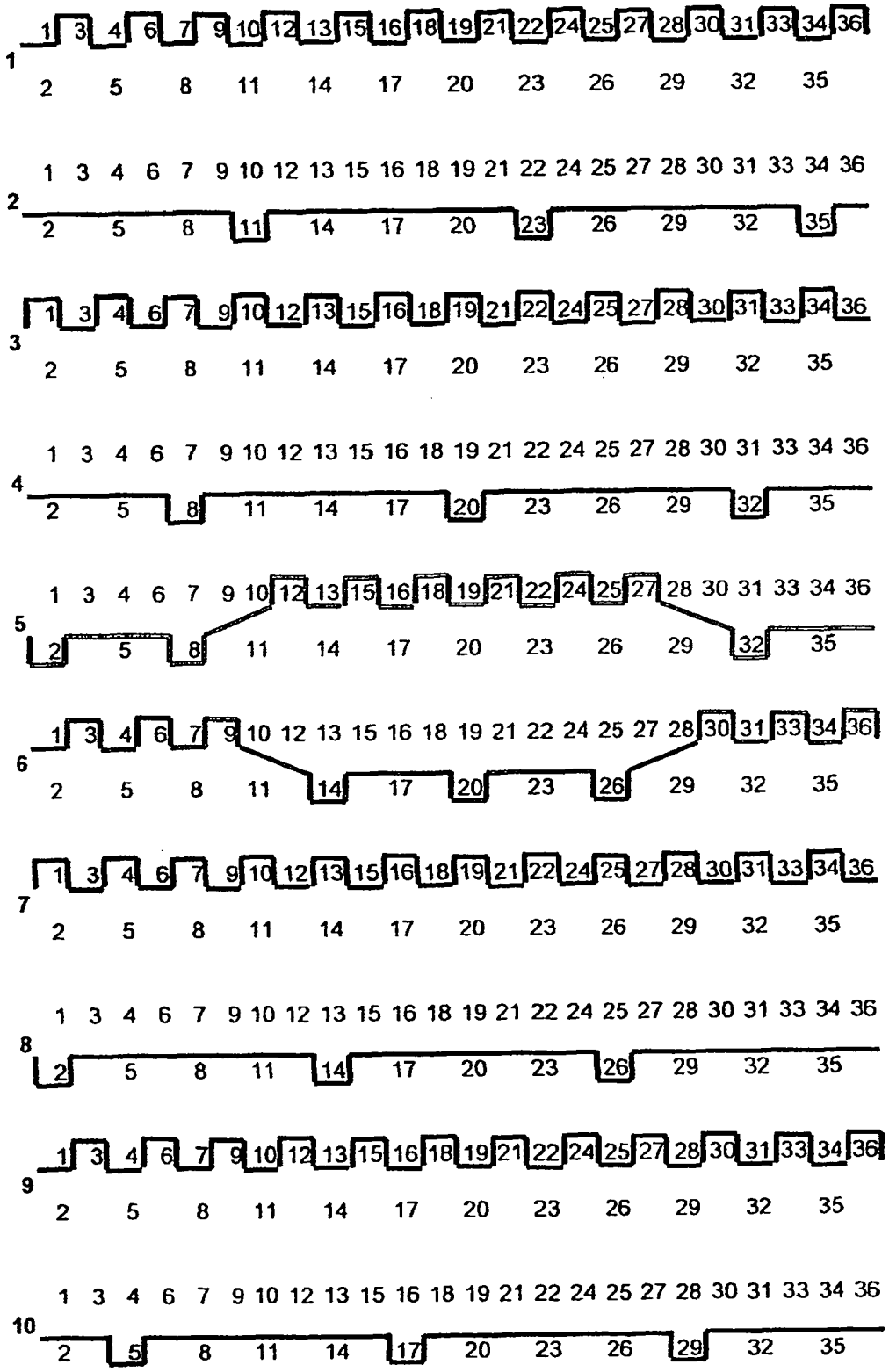
FIG. 6*a* shows a cross-section view of the repeat shown in FIG. 5 and illustrates top warp yarns 1, 3, 7 and 9 (listed on the left-hand side) with warp yarn 5 being a binding warp yarn and bottom warp yarns 2, 4, 8 and 10 (listed on the left-hand side) with warp yarn 6 being a binding warp yarn. The top and bottom weft yarns 1-36 are listed horizontally right to left.
Figure 6B:
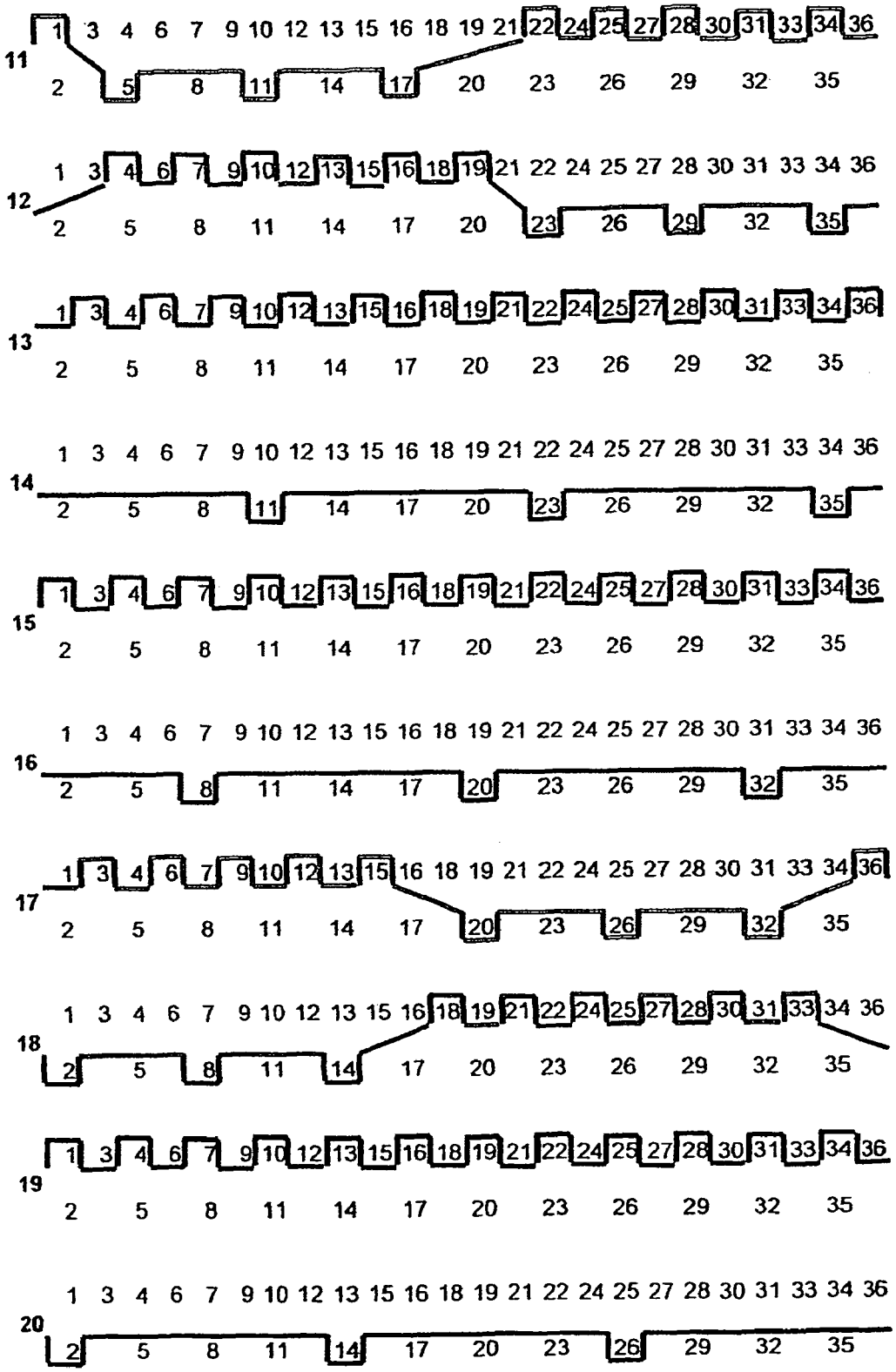
FIG. 6*b* shows a cross-section view of the repeat shown in FIG. 5 and illustrates top warp yarns 13, 15 and 19 (listed on the left-hand side) with warp yarns 11 and 17 being a binding warp yarns and bottom warp yarns 14, 16 and 20 (listed on the left-hand side) with warp yarns 12 and 18 being a binding warp yarns. The top and bottom weft yarns 1-36 are listed horizontally right to left.
Figure 6C:
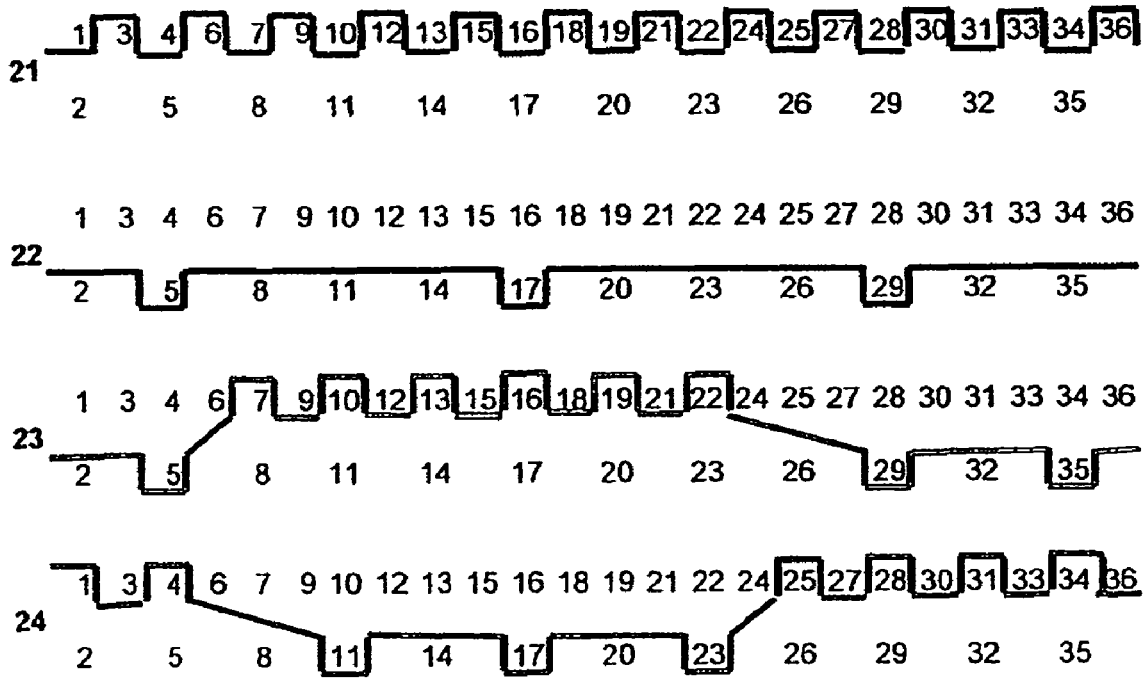
FIG. 6*c* shows a cross-section view of the repeat shown in FIG. 5 and illustrates top warp yarn 21 (listed on the left-hand side) with warp yarn 23 being a binding warp yarn and bottom warp yarn 22 (listed on the left-hand side) with warp yarn 24 being a binding warp yarn. The top and bottom weft yarns 1-36 are listed horizontally right to left.

FIGS. 6*a*-6*c* depict the paths of the upper and lower warp (including binding warp) yarns 1-24 as they weave through the upper and lower weft yarns 1-36. The fabric of FIG. 5 thus shows a single repeat of the fabric that encompasses 36 weft yarns (yarns 1-36 represented horizontally in the figures) and 24 warp yarns (yarns 1-24 represented vertically in the figures). While FIGS. 5-6*c* only show a single repeat unit of the fabric, those of skill in the art will appreciate that in commercial applications, the repeat unit shown in FIGS. 5-6*c* would be repeated many times, in both the warp and weft directions, to form a large fabric suitable for use on a papermaking machine.

With reference to FIG. 6*a*, top warp yarn 1 weaves with a plain weave with top weft yarns 1, 3, 4, 6, 7, 9, 10, 12, 13, 15, 16, 18, 19, 21, 22, 24, 25, 27, 28, 30, 31, 33, 34 and 36 by passing over top weft yarns 3, 6, 9, 12, 15, 18, 21, 24, 27, 30, 33 and 36 and passing under top weft yarns 1, 4, 7, 10, 13, 16, 19, 22, 25, 28, 31 and 34. The top warp yarn 1 thus weaves only in the top layer.

FIG. 6*a* also shows bottom warp yarn 2 passing under bottom weft yarns 2, 5 and 8, then passes over bottom weft yarn 11, then passes under bottom weft yarns 14, 17 and 20, then passes over bottom weft yarn 23, passes under bottom weft yarns 26, 29 and 32, then passes over bottom weft yarn 35. The bottom warp yarn 2 thus weaves only in the bottom layer.

Also seen in FIG. 6*a*, top warp yarn 3 weaves with a plain weave with top weft yarns 1, 3, 4, 6, 7, 9, 10, 12, 13, 15, 16, 18, 19, 21, 22, 24, 25, 27, 28, 30, 31, 33, 34 and 36 by passing over top weft yarns 1, 4, 7, 10, 13, 16, 19, 22, 25, 28, 31 and 34 and passing under top weft yarns 3, 6, 9, 12, 15, 18, 21, 24, 27, 30, 33 and 36. The top warp yarn 3 thus weaves only in the top layer.

FIG. 6*a* additionally shows bottom warp yarn 4 passing under bottom weft yarns 2 and 5, then passes over bottom weft yarn 8, then passes under bottom weft yarns 11, 14 and 17, then passes over bottom weft yarn 20, passes under bottom weft yarns 23, 26 and 29, then passes over bottom weft yarn 32, and then passes under bottom weft yarn 35. The bottom warp yarn 4 thus weaves only in the bottom layer.

FIG. 6*a* further shows binding warp yarn 5 passing over bottom weft yarn 2, then passes under bottom weft yarn 5, then passes over bottom weft yarn 8, then passes from the bottom layer to the top layer by passing under top weft yarns 9 and 10, then weaves with the top weft yarns 12, 13, 15, 16, 18, 19, 21, 22, 24, 25 and 27 to form a plain weave, then passes from the top layer to the bottom layer by passing under top weft yarns 28 and 30, then passes over bottom weft yarn 32, and then passes under bottom weft yarn 35. The binding warp yarn 5 thus weaves in the top layer and binds to the bottom layer by binding with three bottom weft yarns, e.g., by passing over bottom weft yarns 2, 8 and 32.

Also seen in FIG. 6*a*, binding warp yarn 6 weaves with top weft yarns 1, 3, 4, 6, 7 and 9 with a plain weave, then passes from the top layer to the bottom layer by passing under top weft yarns 10 and 12, then passes over bottom weft yarn 14, then passes under bottom weft yarn 17, then passes over bottom weft yarn 20, then passes under bottom weft yarn 23, then passes over bottom weft yarn 26, then passes from the bottom layer to the top layer by passing under top weft yarns 27 and 28, then weaves with the top weft yarns 30, 31, 33, 34 and 36. The binding warp yarn 6 thus weaves in the top layer and binds to the bottom layer by binding with three bottom weft yarns, e.g., by passing over bottom weft yarns 14, 20 and 26. The top and bottom warp yarns 5 and 6 are exchanging warp yarns.

FIG. 6*a* also shows top warp yarn 7 weaving with a plain weave with top weft yarns 1, 3, 4, 6, 7, 9, 10, 12, 13, 15, 16, 18, 19, 21, 22, 24, 25, 27, 28, 30, 31, 33, 34 and 36 by passing over top weft yarns 1, 4, 7, 10, 13, 16, 19, 22, 25, 28, 31 and 34 and passing under top weft yarns 3, 6, 9, 12, 15, 18, 21, 24, 27, 30, 33 and 36. The top warp yarn 7 thus weaves only in the top layer.

Finally, FIG. 6*a* shows bottom warp yarn 8 passing over bottom weft yarn 2, then passes under bottom weft yarns 5, 8 and 11, then passes over bottom weft yarn 14, then passes under bottom weft yarns 17, 20 and 23, then passes over bottom weft yarn 26, passes under bottom weft yarns 29, 32 and 35. The bottom warp yarn 8 thus weaves only in the bottom layer.

With reference to FIG. 6*b*, top warp yarn 9 weaves with a plain weave with top weft yarns 1, 3, 4, 6, 7, 9, 10, 12, 13, 15, 16, 18, 19, 21, 22, 24, 25, 27, 28, 30, 31, 33, 34 and 36 by passing over top weft yarns 3, 6, 9, 12, 15, 18, 21, 24, 27, 30, 33 and 36 and passing under top weft yarns 1, 4, 7, 10, 13, 16, 19, 22, 25, 28, 31 and 34. The top warp yarn 9 thus weaves only in the top layer.

Also seen in FIG. 6*b*, bottom warp yarn 10 passes under bottom weft yarn 2, then passes over bottom weft yarn 5, then passes under bottom weft yarns 8, 11 and 14, then passes over bottom weft yarn 17, passes under bottom weft yarns 20, 23 and 26, then passes over bottom weft yarn 29, and then passes under bottom weft yarns 32 and 35. The bottom warp yarn 10 thus weaves only in the bottom layer.

FIG. 6*b* also shows binding warp yarn 11 weaving with top weft yarn 1 with a plain weave, then passes from the top layer to the bottom layer by passing under top weft yarn 3, then passes over bottom weft yarn 5, then passes under bottom weft yarn 8, then passes over bottom weft yarn 11, then passes under bottom weft yarn 14, then passes over bottom weft yarn 17, then passes from the bottom layer to the top layer by passing under top weft yarns 18, 19 and 21, then weaves with the top weft yarns 22, 24, 25, 27, 28, 30, 31, 33, 34 and 36. The binding warp yarn 11 thus weaves in the top layer and binds to the bottom layer by binding with three bottom weft yarns, e.g., by passing over bottom weft yarns 5, 11 and 17.

Also illustrated in FIG. 6*b*, binding warp yarn 12 passes from the bottom layer to the top layer by passing under top weft yarns 1 and 3, then weaves with the top weft yarns 4, 6, 7, 9, 10, 12, 13, 15, 16, 18 and 19 to form a plain weave, then passes from the top layer to the bottom layer by passing under top weft yarn 21, then passes over bottom weft yarn 23, then passes under bottom weft yarn 26, then passes over bottom weft yarn 29, then passes under bottom weft yarn 32, then passes over bottom weft yarn 35. The binding warp yarn 12 thus weaves in the top layer and binds to the bottom layer by binding with three bottom weft yarns, e.g., by passing over bottom weft yarns 23, 29 and 35.

FIG. 6*b* also shows top warp yarn 13 weaving with a plain weave with top weft yarns 1, 3, 4, 6, 7, 9, 10, 12, 13, 15, 16, 18, 19, 21, 22, 24, 25, 27, 28, 30, 31, 33, 34 and 36 by passing over top weft yarns 3, 6, 9, 12, 15, 18, 21, 24, 27, 30, 33 and 36 and passing under top weft yarns 1, 4, 7, 10, 13, 16, 19, 22, 25, 28, 31 and 34. The top warp yarn 13 thus weaves only in the top layer.

FIG. 6*b* additionally shows bottom warp yarn 14 passing under bottom weft yarns 2, 5 and 8, then passes over bottom weft yarn 11, then passes under bottom weft yarns 14, 17 and 20, then passes over bottom weft yarn 23, passes under bottom weft yarns 26, 29 and 32, then passes over bottom weft yarn 35. The bottom warp yarn 14 thus weaves only in the bottom layer.

Also seen in FIG. 6*b*, top warp yarn 15 weaves with a plain weave with top weft yarns 1, 3, 4, 6, 7, 9, 10, 12, 13, 15, 16, 18, 19, 21, 22, 24, 25, 27, 28, 30, 31, 33, 34 and 36 by passing over top weft yarns 1, 4, 7, 10, 13, 16, 19, 22, 25, 28, 31 and 34 and passing under top weft yarns 3, 6, 9, 12, 15, 18, 21, 24, 27, 30, 33 and 36. The top warp yarn 15 thus weaves only in the top layer.

FIG. 6*b* further shows bottom warp yarn 16 passing under bottom weft yarns 2 and 5, then passes over bottom weft yarn 8, then passes under bottom weft yarns 11, 14 and 17, then passes over bottom weft yarn 20, passes under bottom weft yarns 23, 26 and 29, then passes over bottom weft yarn 32, and then passes under bottom weft yarn 35. The bottom warp yarn 16 thus weaves only in the bottom layer.

Also seen in FIG. 6*b*, binding warp yarn 17 weaves with top weft yarns 1, 3, 4, 6, 7, 9, 10, 12, 13, and 15 with a plain weave, then passes from the top layer to the bottom layer by passing under top weft yarns 16 and 18, then passes over bottom weft yarn 20, then passes under bottom weft yarn 23, then passes over bottom weft yarn 26, then passes under bottom weft yarn 29, then passes over bottom weft yarn 32, then passes from the bottom layer to the top layer by passing under top weft yarns 33 and 34, then weaves with the top weft yarn 36. The binding warp yarn 17 thus weaves in the top layer and binds to the bottom layer by binding with three bottom weft yarns, e.g., by passing over bottom weft yarns 20, 26 and 32.

Moreover, FIG. 6*b* shows binding warp yarn 18 passing over bottom weft yarn 2, then passes under bottom weft yarn 5, then passes over bottom weft yarn 8, then passes under bottom weft yarn 11, then passes over bottom weft yarn 14, then passes from the bottom layer to the top layer by passing under top weft yarns 15 and 16, then weaves with the top weft yarns 18, 19, 21, 22, 24, 25, 27, 28, 30, 31 and 33, and then passes from the top layer to the bottom layer by passing under top weft yarns 34 and 36. The binding warp yarn 18 thus weaves in the top layer and binds to the bottom layer by binding with three bottom weft yarns, e.g., by passing over bottom weft yarns 2, 8 and 14.

Also seen in FIG. 6*b*, top warp yarn 19 weaves with a plain weave with top weft yarns 1, 3, 4, 6, 7, 9, 10, 12, 13, 15, 16, 18, 19, 21, 22, 24, 25, 27, 28, 30, 31, 33, 34 and 36 by passing over top weft yarns 1, 4, 7, 10, 13, 16, 19, 22, 25, 28, 31 and 34 and passing under top weft yarns 3, 6, 9, 12, 15, 18, 21, 24, 27, 30, 33 and 36. The top warp yarn 19 thus weaves only in the top layer.

Finally, FIG. 6*b* shows bottom warp yarn 20 passing over bottom weft yarn 2, then passes under bottom weft yarns 5, 8 and 11, then passes over bottom weft yarn 14, then passes under bottom weft yarns 17, 20 and 23, then passes over bottom weft yarn 26, passes under bottom weft yarns 29, 32 and 35. The bottom warp yarn 20 thus weaves only in the bottom layer.

With reference to FIG. 6*c*, top warp yarn 21 weaves with a plain weave with top weft yarns 1, 3, 4, 6, 7, 9, 10, 12, 13, 15, 16, 18, 19, 21, 22, 24, 25, 27, 28, 30, 31, 33, 34 and 36 by passing over top weft yarns 3, 6, 9, 12, 15, 18, 21, 24, 27, 30, 33 and 36 and passing under top weft yarns 1, 4, 7, 10, 13, 16, 19, 22, 25, 28, 31 and 34. The top warp yarn 21 thus weaves only in the top layer.

Also shown in FIG. 6*c*, bottom warp yarn 22 passes under bottom weft yarn 2, then passes over bottom weft yarn 5, then passes under bottom weft yarns 8, 11 and 14, then passes over bottom weft yarn 17, passes under bottom weft yarns 20, 23 and 26, then passes over bottom weft yarn 29, and the passes under bottom weft yarns 32 and 35. The bottom warp yarn 22 thus weaves only in the bottom layer.

FIG. 6*c* also shows binding warp yarn 23 passing under bottom weft yarn 2, then passes over bottom weft yarn 5, then passes from the bottom layer to the top layer by passing under top weft yarn 6, then weaves with the top weft yarns 7, 9, 10, 12, 13, 15, 16, 18, 19, 21 and 22 to form a plain weave, then passes from the top layer to the bottom layer by passing under top weft yarns 24, 25 and 27, then passes over bottom weft yarn 29, and then passes under bottom weft yarn 32, and then passes over bottom weft yarn 35. The binding warp yarn 23 thus weaves in the top layer and binds to the bottom layer by binding with three bottom weft yarns, e.g., by passing over bottom weft yarns 5, 29 and 35.

Finally, as shown in FIG. 6*c*, binding warp yarn 24 weaves with top weft yarns 1, 3 and 4 with a plain weave, then passes from the top layer to the bottom layer by passing under top weft yarns 6, 7 and 9, then passes over bottom weft yarn 11, then passes under bottom weft yarn 14, then passes over bottom weft yarn 17, then passes under bottom weft yarn 20, then passes over bottom weft yarn 23, then passes from the bottom layer to the top layer by passing under top weft yarn 24, then weaves with the top weft yarns 25, 27, 28, 30, 31, 33, 34 and 36. The binding warp yarn 24 thus weaves in the top layer and binds to the bottom layer by binding with three bottom weft yarns, e.g., by passing over bottom weft yarns 11, 17 and 23.

By way of non-limiting example, the top warp (including binding warp) yarns 1, 3, 5, 7, 9, 11, 13, 15, 17, 19, 21 and 23 of the embodiment shown in FIGS. 5-6*c* can have the following characteristics: acceptable size range of between approximately 0.10 mm and approximately 0.50 mm, preferable size ranges of between approximately 0.20 mm and approximately 0.80 mm, and most preferred size range of between approximately 0.12 mm and approximately 0.20 mm. The material for these yarns can be any natural or synthetic material, preferably a synthetic monofilament, and most preferably a polyester monofilament.

By way of non-limiting example, the bottom warp (including binding warp) yarns 2, 4, 6, 8, 10, 12, 14, 16, 18, 20, 22 and 24 of the embodiment shown in FIGS. 5-6*c* can have the following characteristics: acceptable size range of between approximately 0.15 mm and approximately 0.60 mm, preferable size ranges of between approximately 0.20 mm and approximately 0.40 mm, and most preferred size range of between approximately 0.25 mm and approximately 0.35 mm. The material for these yarns can be any natural or synthetic material, preferably a synthetic monofilament, and most preferably a polyester monofilament. The bottom warp yarns can preferably be constructed using relatively large diameter yarns that are well suited to sustain the wear caused by the friction between the machine side surface of the fabric and the papermaking machine during use of the fabric.

By way of non-limiting example, the top weft yarns 1, 3, 4, 6, 7, 9, 10, 12, 13, 15, 16, 18, 19, 21, 22, 24, 25, 27, 28, 30, 31, 33, 34 and 36 of the embodiment shown in FIGS. 5-6*c* can have the following characteristics: acceptable size range of between approximately 0.10 mm and approximately 0.50 mm, preferable size ranges of between approximately 0.20 mm and approximately 0.80 mm, and most preferred size range of between approximately 0.12 mm and approximately 0.80 mm. The material for these yarns can be any natural or synthetic material, preferably a synthetic monofilament, and most preferably a polyester monofilament.

By way of non-limiting example, the bottom weft yarns 2, 5, 8, 11, 14, 17, 20, 23, 26, 29, 32 and 35 of the embodiment shown in FIGS. 5-6*c* can have the following characteristics: acceptable size range of between approximately 0.15 mm and approximately 0.60 mm, preferable size ranges of between approximately 0.20 mm and approximately 0.40 mm, and most preferred size range of between approximately 0.25 mm and approximately 0.35 mm. The material for these yarns can be any natural or synthetic material, preferably a synthetic monofilament, and most preferably a polyester monofilament. These bottom weft yarns may also be constructed using larger diameter yarns than the upper warp yarns.

In the embodiment shown in FIGS. 5-6*c* all of the non-exchanging top warp yarns form a plain weave in the top layer. All of the exchanging top and bottom pairs also weave in the top layer with a plain weave and bind with three bottom weft yarns and/or weave with five bottom weft yarns. Furthermore, all of the non-exchanging bottom warp yarns weave only in the bottom layer. When a top warp yarn passes from the top layer to the bottom layer, it passes under at least one top weft yarn before binding with the bottom layer. When a bottom warp yarn passes from the bottom layer to the top layer, it passes under at least one top weft yarn before weaving with the top layer. Finally, the pattern repeat utilizes four exchanging top and bottom warp pairs and eight non-exchanging top and bottom warp pairs. Thus, the repeat has the following configuration of warp pairs: a pair of non-exchanging warp yarns 1 and 2 followed by another pair of non-exchanging warp yarns 3 and 4, and then followed by a pair of exchanging warp yarns 5 and 6; then a pair of non-exchanging warp yarns 7 and 8 followed by another pair of non-exchanging warp yarns 9 and 10, and then followed by a pair of exchanging warp yarns 11 and 12; then a pair of non-exchanging warp yarns 13 and 14 followed by another pair of non-exchanging warp yarns 15 and 16, and then followed by a pair of exchanging warp yarns 17 and 18; then a pair of non-exchanging warp yarns 19 and 20 followed by another pair of non-exchanging warp yarns 21 and 22, and then followed by a pair of exchanging warp yarns 23 and 24. These features are desirable in numerous papermaking applications.

The invention encompasses a variety of different types of fabrics. For instance, the invention noted herein encompasses fabrics woven with different repeat than that pictured and described above. The fabric can have various top to bottom warp yarn ratios. The invention further contemplates other multilayer fabrics and not just the multilayer fabrics depicted in the figures.

The fabrics pictured and otherwise described and claimed herein may be employed in a variety of applications, including board and packaging grades.

The configurations of the individual yarns utilized in the fabrics of the present invention can vary, depending upon the desired properties of the final papermakers' fabric. For example, the yarns may be multifilament yarns, monofilament yarns, twisted multifilament or monofilament yarns, spun yarns, or any combination thereof. Also, the materials comprising yarns employed in the fabric of the present invention may be those commonly used in papermakers' fabric. For example, the yarns may be formed of polypropylene, polyester, nylon, or the like. The skilled artisan should select a yarn material according to the particular application of the final fabric. Those of skill in the art will appreciate that yarns having diameters outside the herein disclosed ranges may be used in certain applications. In one embodiment of the present invention, one or more of the weft and warp yarns can have a diameter of about 0.13 mm, or about 0.17 mm, or about 0.33, or about 0.36 mm. Fabrics employing these yarn sizes may be implemented with polyester yarns or with a combination of polyester and nylon yarns.

The fabrics of the present invention have been described herein are flat woven fabrics and hence the warp yarns for these fabrics run in the machine direction (a direction aligned with the direction of travel of the papermakers' fabric on the papermaking machine) when the fabric is used on a papermaking machine and the weft yarns for these fabrics run in the cross machine direction (a direction parallel to the fabric surface and traverse to the direction of travel) when the fabric is used on a papermaking machine. However, those of skill in the art will appreciate that the fabrics of the present invention could also be woven using an endless weaving process. If such endless weaving were used, the warp yarns would run in the cross machine direction and the weft yarns would run in the machine direction when the fabric was used on a papermaking machine.

Pursuant to another aspect of the present invention, methods of making the papermaker's fabrics are provided. Pursuant to these methods, the fabrics can be woven using separate warp and weft beams.

Pursuant to another aspect of the present invention, methods of making paper are provided. Pursuant to these methods, one of the exemplary papermaker's forming fabrics described herein is provided, and paper is then made by applying paper stock to the forming fabric and by then removing moisture from the paper stock. As the details of how the paper stock is applied to the forming fabric and how moisture is removed from the paperstock is well understood by those of skill in the art, additional details regarding this aspect of the present invention will not be provided herein.

To the extent that the pattern repeat symbols shown in FIGS. 1, 3 and 5 are inconsistent with the respective weave patterns shown in FIGS. 2*a*-2*c*, 4*a*-4*c* and 6*a*-6*c*, the paths shown in FIGS. 2*a*-2*c*, 4*a*-4*c* and 6*a*-6*c* shall serve as a basis for correcting the symbols shown in FIGS. 1, 3 and 5. Applicant also reserves the right to submit any additional drawings showing weave patterns of the type shown in FIGS. 2*a*-2*c*, 4*a*-4*c* and 6*a*-6*c* for any pattern repeat shown in FIGS. 1, 3 and 5 which are not deemed to be consistent with the weave patterns shown in FIGS. 2*a*-2*c*, 4*a*-4*c* and 6*a*-6*c*.

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A forming fabric comprising:

a top layer comprising top weft yarns;

a bottom layer comprising bottom weft yarns;

at least two adjacent pairs of binding warp yarns; and at least two adjacent pairs of top and bottom warp yarns.

2. The fabric of claim 1, wherein one pair of the at least two pairs of binding warp yarns are arranged adjacent one of the at least two adjacent top and bottom warp yarns.

3. The fabric of claim 1, wherein at least one of the at least two pairs of binding warp yarns comprises vertically stacked binding warp yarns weaving with a plain weave in the top layer and binding with non-adjacent bottom weft yarns.

4. The fabric of claim 1, wherein each of the at least two pairs of binding warp yarns comprises vertically stacked binding warp yarns weaving with a plain weave in the top layer and binding with non-adjacent bottom weft yarns.

5. The fabric of claim 1, wherein at least one of the at least two pairs of binding warp yarns comprises vertically stacked binding warp yarns weaving with a plain weave in the top layer and binding with two non-adjacent bottom weft yarns.

6. The fabric of claim 1, wherein each of the at least two pairs of binding warp yarns comprises vertically stacked binding warp yarns weaving with a plain weave in the top layer and binding with two non-adjacent bottom weft yarns.

7. The fabric of claim 1, wherein the at least two pairs of binding warp yarns comprises a first pair of vertically stacked binding warp yarns weaving with a plain weave in the top layer and binding with two non-adjacent bottom weft yarns and a second pair of vertically stacked binding warp yarns weaving with a plain weave in the top layer and binding with two different non-adjacent bottom weft yarns.

8. The fabric of claim 1, wherein at least one of the at least two pairs of binding warp yarns comprises:

a first binding warp yarn binding with bottom weft yarns per pattern repeat and being arranged adjacent one of the at least two adjacent top warp yarns; and a second binding warp yarn weaving with top weft yarns and being arranged adjacent one of the at least two adjacent bottom warp yarns.

9. The fabric of claim 1, wherein at least one of the at least two pairs of binding warp yarns comprises:

a first binding warp yarn weaving with a plain weave in the top layer, binding with at least two bottom weft yarns per pattern repeat, and being arranged adjacent one of the at least two adjacent top warp yarns; and a second binding warp yarn weaving with a plain weave in the top layer, binding with at least two top weft yarns per pattern repeat, and being arranged adjacent one of the at least two adjacent bottom warp yarns.

10. The fabric of claim 1, wherein the top warp yarns weave only in the top layer form a plain weave with the top weft yarns.

11. The fabric of claim 1, wherein the bottom warp yarns weave only in the bottom layer bind with non-adjacent bottom weft yarns per pattern repeat.

12. The fabric of claim 1, wherein the bottom warp yarns weave only in the bottom layer bind with two non-adjacent bottom weft yarns per pattern repeat.

13. The fabric of claim 1, wherein the at least two pairs of binding warp yarns comprises:

two adjacent first binding warp yarns passing over more top weft yarns than bottom weft yarns; and two adjacent second binding warp yarns passing over more top weft yarns than bottom weft yarns.

14. The fabric of claim 1, wherein at least one of the at least two pairs of binding warp yarns comprises:

a first binding warp yarn weaving with a plain weave with a first set of top weft yarns; and a second binding warp yarn weaving with a plain weave with a second set of top weft yarns.

15. The fabric of claim 1, wherein at least one of the at least two pairs of binding warp yarns comprises:

a first binding warp yarn weaving with a plain weave with a first set of top weft yarns; and a second binding warp yarn weaving with a plain weave with a different second set of top weft yarns.

16. The fabric of claim 1, wherein the at least two pairs of binding warp yarns comprises:

two adjacent first binding warp yarns weaving with a plain weave with a first set of top weft yarns; and two adjacent second binding warp yarns weaving with a plain weave with a second set of top weft yarns.

17. The fabric of claim 1, wherein the at least two pairs of binding warp yarns comprises:

two adjacent first binding warp yarns weaving with a plain weave with a first set of top weft yarns; and two adjacent second binding warp yarns weaving with a plain weave with a different second set of top weft yarns.

18. The fabric of claim 1, wherein at least one of:

the top layer has a different weave pattern than the bottom layer; and the top layer utilizes a plain weave and the bottom layer does not utilize a plain weave.

19. The fabric of claim 1, wherein the top layer has a papermaking surface and the bottom has a machine side surface.

20. The fabric of claim 1, each of the top warp yarns weaves only in the top layer is vertically stacked with respect to each of the bottom warp yarns weaving only in the bottom layer.

21. The fabric of claim 1, the at least two pairs of binding warp yarns are vertically stacked.

22. The fabric of claim 1, wherein at least one of the top warp yarns per pattern repeat differ from the bottom warp yarns in at least one of the following characteristics:

size;

modulus; and material.

23. The fabric of claim 1, wherein at least one of the top weft yarns per pattern repeat differ from the bottom weft yarns in at least one of the following characteristics:

size;

modulus; and material.

24. The fabric of claim 1, wherein at least one of the top warp yarns is smaller in size than at least one of the bottom warp yarns.

25. The fabric of claim 1, each of the at least two adjacent pairs of binding warp yarns binds with only two bottom weft yarns per pattern repeat.

26. The fabric of claim 1, each of the at least two adjacent pairs of binding warp yarns weaves in the top layer with a plain weave and binds with only two bottom weft yarns per pattern repeat.

27. The fabric of claim 1, each of the at least two adjacent pairs of binding warp yarns comprises intrinsic binding warp yarns.

28. The fabric of claim 1, wherein the at least two adjacent pairs of binding warp yarns comprises:

two adjacent first binding warp yarns each binding with two bottom weft yarns per pattern repeat and weaving with plural top weft yarns; and two adjacent second binding warp yarns each binding with two bottom weft yarns per pattern repeat and weaving with plural two top weft yarns.

29. The fabric of claim 1, wherein the at least two adjacent pairs of binding warp yarns comprises:

two adjacent first binding warp yarns each binding with two bottom weft yarns per pattern repeat and weaving with plural top weft yarns in a plain weave; and two adjacent second binding warp yarns each binding with two bottom weft yarns per pattern repeat and weaving with plural two top weft yarns in a plain weave.

30. The fabric of claim 1, wherein the at least two adjacent pairs of binding warp yarns comprises:

two adjacent first binding warp yarns each binding with two different bottom weft yarns per pattern repeat and weaving with plural top weft yarns in a plain weave; and two adjacent second binding warp yarns each binding with two different bottom weft yarns per pattern repeat and weaving with plural two top weft yarns in a plain weave.

31. The fabric of claim 1, wherein the at least two adjacent pairs of binding warp yarns comprises:

two adjacent first binding warp yarns each binding with two non-adjacent bottom weft yarns per pattern repeat and weaving with plural top weft yarns in a plain weave; and two adjacent second binding warp yarns each binding with two non-adjacent bottom weft yarns per pattern repeat and weaving with plural two top weft yarns in a plain weave.

32. The fabric of claim 1, wherein the at least two adjacent pairs of binding warp yarns comprises:

two adjacent first binding warp yarns each binding with two different non-adjacent bottom weft yarns per pattern repeat and weaving with plural top weft yarns in a plain weave; and two adjacent second binding warp yarns each binding with two different non-adjacent bottom weft yarns per pattern repeat and weaving with plural two top weft yarns in a plain weave.

33. The fabric of claim 1, wherein the at least two adjacent pairs of binding warp yarns comprises:

two adjacent first binding warp yarns each binding with two bottom weft yarns per pattern repeat and weaving with eleven top weft yarns; and two adjacent second binding warp yarns each binding with two bottom weft yarns per pattern repeat and weaving with eleven top weft yarns.

34. A forming fabric comprising:

a top layer comprising top weft yarns;

a bottom layer comprising bottom weft yarns; and in a pattern repeat, at least the following warp yarns:

a first pair of top and bottom warp yarns;

a second pair of top and bottom warp yarns arranged adjacent the first pair;

a pair of binding warp yarns arranged adjacent the second pair;

a third pair of top and bottom warp yarns arranged adjacent the pair of binding warp yarns; and a fourth pair of top and bottom warp yarns arranged adjacent the third pair.

35. The fabric of claim 34, wherein at least one of:

the bottom warp yarns weave with non-adjacent bottom weft yarns;

the bottom warp yarns weave with two non-adjacent bottom weft yarns;

the bottom warp yarns weave with four non-adjacent bottom weft yarns; and the bottom warp yarns weave with different non-adjacent bottom weft yarns.

36. The forming fabric of claim 34, wherein one of:

each binding warp yarn weaves in the top layer with a plain weave and binds with non-adjacent bottom weft yarns;

each binding warp yarn weaves in the top layer with a plain weave and binds with two non-adjacent bottom weft yarns; and each binding warp yarn weaves in the top layer with a plain weave and binds with four non-adjacent bottom weft yarns.

37. A forming fabric comprising:

a top layer comprising top weft yarns;

a bottom layer comprising bottom weft yarns; and in a pattern repeat, at least the following warp yarns:

a first pair of top and bottom warp yarns;

a second pair of top and bottom warp yarns arranged adjacent the first pair;

a third pair of top and bottom warp yarns;

a fourth pair of top and bottom warp yarns arranged adjacent the third pair; and two pairs of adjacent binding warp yarns arranged between the second and third pairs.

38. The forming fabric of claim 37, wherein:

each of the top warp yarns weaves with a plain weave in the top layer and each of the bottom warp yarns weaves in the bottom layer with a non-plain weave; and each of the binding warp yarns weaves with a plain weave in the top layer and binds to non-adjacent bottom weft yarns.

39. A method of making the fabric of claim 1, comprising:

binding together the top and bottom layers.

40. A method of making the fabric of claim 1, comprising:

weaving together the top and bottom layers with the at least two pairs of adjacent binding warp yarns.

41. A forming fabric comprising:

a top layer comprising top weft yarns;

a bottom layer comprising bottom weft yarns;

a pair of vertically stacked binding warp yarns; and a first pair of top and bottom warp yarns arranged adjacent the pair of vertically stacked binding warp yarns;

a second pair of top and bottom warp yarns arranged adjacent the first pair of top and bottom warp yarns;

the top warp yarns of the first and second pairs weaving only with the top weft yarns; and the bottom warp yarns of the first and second pairs weaving only with the bottom weft yarns.

42. The fabric of claim 41, wherein the top warp yarns of the first and second pairs weave with the top weft yarns with a plain weave and wherein each warp yarn of the pair of vertically stacked binding warp yarns binds, in a pattern repeat, to one of:

only one bottom weft yarn;

only two non-adjacent bottom weft yarns; and only three non-adjacent bottom weft yarns.

* * * * *